US005326680A

United States Patent [19]

Ohkawa et al.

[11] Patent Number: 5,326,680

[45] Date of Patent: Jul. 5, 1994

[54] SILVER HALIDE COLOR PHOTOGRAPHIC LIGHT-SENSITIVE MATERIAL

[75] Inventors: Atsuhiro Ohkawa; Tatsuhiko Obayashi; Keiji Mihayashi, all of Kanagawa, Japan

[73] Assignee: Fuji Photo Film Co., Ltd., Kanagawa, Japan

[21] Appl. No.: 885,359

[22] Filed: May 19, 1992

[30] Foreign Application Priority Data

May 22, 1991 [JP] Japan ..... 3-145175

[51] Int. Cl.[5] ..... G03C 7/26; G03C 7/32; G03C 1/42

[52] U.S. Cl. ..... 430/544; 430/223; 430/226; 430/543; 430/548; 430/559; 430/564; 430/566; 430/598; 430/955; 430/957; 430/959

[58] Field of Search ..... 430/223, 226, 544, 955, 430/957, 548, 959, 543, 555, 553, 557, 558 R, 559, 564, 566, 598

[56] References Cited

U.S. PATENT DOCUMENTS

| | | | |
|---|---|---|---|
| 4,840,884 | 6/1989 | Mooberry et al. | 430/226 |
| 4,857,440 | 8/1989 | Begley et al. | 430/544 |
| 4,861,701 | 8/1989 | Burns et al. | 430/544 |
| 5,085,971 | 2/1992 | Katoh et al. | 430/544 |

*Primary Examiner*—Richard L. Schilling

*Attorney, Agent, or Firm*—Sughrue, Mion, Zinn, Macpeak & Seas

[57] ABSTRACT

A silver halide color photographic light-sensitive material having at least one light-sensitive silver halide emulsion layer formed on a support wherein the light-sensitive material contains a compound represented by the following general formula (I):

General formula (I)

wherein A is a coupler residual or an oxidation-reduction group, $X_1$ is an oxygen atom or a sulfur atom, $X_2$ is an oxygen atom, a sulfur atom or $NX_6$ group, W is a carbon atom or a sulfur atom, $X_3$, $X_4$, $X_5$ and $X_6$ are each a hydrogen atom or an organic residual, any two of $X_3$, $X_4$ and $X_5$ can be bivalent groups which form a ring, PUG is a photographically useful group capable of bonding at a hetero-atom and, in the formula (I), $n_1$ is 1 if W is a carbon atom, and either 1 or 2 if W is a sulfur atom. If $n_1$ is 2, two $X_1$ can either be identical or different. On the other hand, $n_2$ is either 1 or 2. If $n_2$ is 2, two $X_3$, two $X_4$, and two $x_5$ are either identical or different.

9 Claims, No Drawings

SILVER HALIDE COLOR PHOTOGRAPHIC LIGHT-SENSITIVE MATERIAL

BACKGROUND OF THE INVENTION

1. Field of the Invention

The present invention relates to a silver halide color photographic light-sensitive material which contains a novel compound capable of releasing, at appropriate timing, a development restrainer having great ability of restraining development.

2. Description of the Related Art

In recent years, a demand has arisen for a silver halide light-sensitive material, particularly for a color light-sensitive material for photographing which excels in granularity, sharpness, color reproducibility and storage stability, such as an ISO400 light-sensitive material (Super HG-400) having light sensitivity close to ISO sensitivity of 100.

Compounds which imagewise release a development restrainer by virtue of two or more timing groups, as compounds which improve the sharpness of the light-sensitive material, without degrading the storage stability of the light-sensitive material are disclosed in, for example, British Patent 1,531,927, JP-A-60-218645 ("JP-A" means Unexamined Published Japanese Patent Application), JP-A-60-249148, JP-A-61-156127, U.S. Pat. Nos. 4,861,701 and 4,698,297. However, they release a development restrainer at improper speed (or timing). Further, the development restrainer has improper diffusibility. Consequently, the compounds do not serve sharpness, granularity, color reproducibility, or the like. Many of light-sensitive materials containing such a compound will more likely be fogged excessively or become less light-sensitive than desired, if they are left to stand or if they are kept at high temperatures and high humidities, for a long period of time after exposure process until development process.

SUMMARY OF THE INVENTION

The object of the present invention is to provide a silver halide color photographic light-sensitive material which excels in sharpness, granularity and color reproducibility, and whose photographic properties vary little for a long time between photographing (exposure) process and development process.

The object of the invention has been achieved by a silver halide color photographic light-sensitive material comprising at least one silver halide emulsion layer formed on a support and containing at least one compound which is represented by the following general formula (I):

General formula (I)

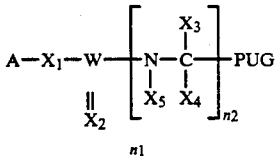

wherein A is a coupler residual group or an oxidation-reduction group, $X_1$ is an oxygen atom or a sulfur atom, $X_2$ is an oxygen atom, a sulfur atom or $=NX_6$ group, W is a carbon atom or a sulfur atom, $X_3$, $X_4$, $X_5$ and $X_6$ are each a hydrogen atom or an organic residual group, and any two of $X_3$, $X_4$ and $X_5$ can be bivalent groups which form a ring. PUG is a photographically useful group which is capable of bonding at a hetero-atom. In the formula (I), $n_1$ is 1 if W is a carbon atom, and either 1 or 2 if W is a sulfur atom. If $n_1$ is 2, two $X_2$ can either be identical or different. On the other hand, $n_2$ is either 1 or 2. If $n_2$ is 2, two $X_3$, two $X_4$, and two $X_5$ are either identical or different.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

When the compound represented by the general formula (I) reacts with a developing-oxidizing agent (Dox), A and $X_1$ are clove each other, then W and N are clove each other, next N and C are clove each other if $n_2$ is 2, and finally the bond between PUG and C is clove each other, whereby PUG is released from the compound, as is evident from the following scheme 1.

Scheme 1

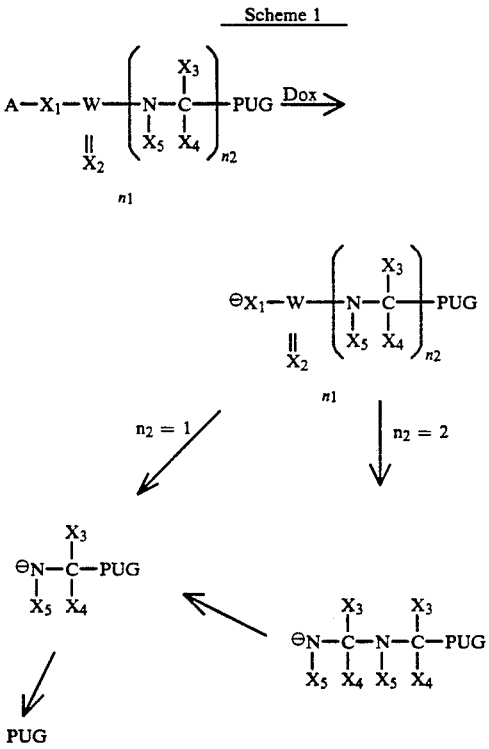

As has been pointed out, A in the formula (I) is a coupler residual group or an oxidation-reduction group. Examples of the coupler residual group are: an yellow coupler residual group (e.g., an open chain ketomethylene-type coupler residual group such as acylacetoanlide or malondianilide), a magenta coupler residual group (e.g., a coupler residual group such as a 5-pyrazolone-type one, a pyrazolotriazole-type one, or an imidazopyrazole-type one), a cyan coupler residual group (e.g., a phenol-type one, a naphthol-type one, an imidazole-type one disclosed in Laid-open European Patent Application 249,453, or a pyrazolopyrimidine-type one disclosed in Laid-open European Patent Application 304,001), and a colorless compound forming coupler residual group (e.g., an indanone-type one or an acetophenone-type one). Other examples of the coupler residual group are the heterocyclic coupler residual groups which are disclosed in U.S. Pat. Nos. 4,315,070, 4,183,752, 4,174,969, 3,961,959 and 4,171,223, and JP-A-52-82423.

If A is an oxidation-reduction group, this is a group that can be cross-oxidized by the developing-oxidizing agent. Examples of the oxidation-reduction group are: hydroquinones, catechols, pyrogallols, 1,4-naphthohydroquinones, 1,2-naphthohydroquinones, sulfonamidephenols, hydrazides and sulfonamide-naphthols. These groups can be those disclosed in JP-A-61-230135, JP-A-62-251746, JP-A-61-278852, U.S. Pat. Nos. 3,364,022, 3,379,529, 3,639,417, 4,684,604, and J. Org. Chem., 29, 588 (1964).

Of the coupler residual groups mentioned above, preferable are those represented by the following formulas (Cp-1), (Cp-2), (Cp-3), (Cp-4), (Cp-5), (Cp-6), (Cp-7), (Cp-8), (Cp-9), (Cp-10), and (Cp-11). These couplers have high coupling rate.

General formula (Cp-1)

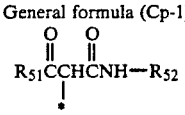

General formula (Cp-2)

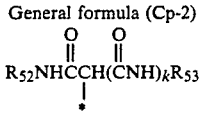

General formula (Cp-3)

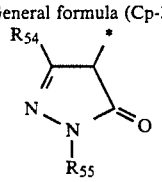

General formula (Cp-4)

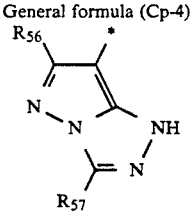

General formula (Cp-5)

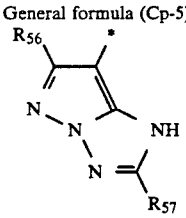

General formula (Cp-6)

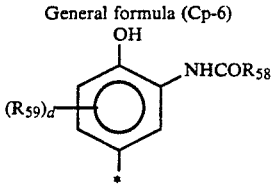

-continued

General formula (Cp-7)

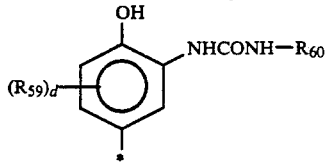

General formula (Cp-8)

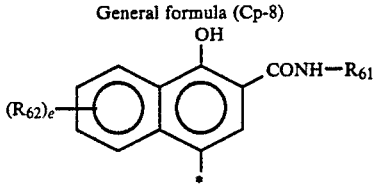

General formula (Cp-9)

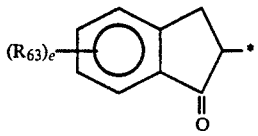

General formula (Cp-10)

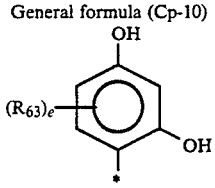

General formula (Cp-11)

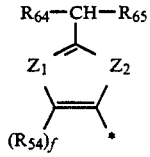

In the formulas mentioned above, the mark * attached to the coupling position is represented the bonding position of X1.

If $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, $R_{63}$, $R_{64}$, or $R_{55}$ in the formulas contains a nondiffusing group, the non-diffusible group is selected such that coupler residual group has 8 to 40 carbon atoms in all, preferably 10 to 30 carbon atoms. Otherwise, the nondiffusing group is selected preferably such that coupler residual group has 15 carbon atoms or less carbon atoms.

$R_{51}$ to $R_{65}$, k, d, e, and f, shown in the formulas, will be explained in detail. $R_{41}$ is aliphatic group, aromatic group or heterocyclic group, and $R_{42}$ is aromatic group or heterocyclic group. $R_{43}$, $R_{44}$, and $R_{45}$ are hydrogen atoms, aliphatic groups, aromatic groups, or heterocyclic groups.

$R_{51}$ has the same meaning as $R_{41}$. $R_{52}$ and $R_{53}$ have the same meaning as $R_{42}$. The notation of "k" is 0 or 1. $R_{54}$ is a group of the same meaning as $R_{41}$; it is $R_{41}CON(R_{43})$— group, $R_{41}R_{43}N$— group, $R_{41}SO_2N(R_{43})$— group, $R_{41}S$— group, $R_{43}O$— group, $R_{45}N(R_{43})CON(R_{44})$— group, or N≡C— group. $R_{55}$ is a group of the same meaning as $R_{41}$. $R_{56}$ and $R_{57}$ are groups of the same meaning as $R_{43}$; they are $R_{41}S$— groups, $R_{43}O$— groups, $R_{41}CON(R_{43})$— groups, or $R_{41}SO_2N(R_{43})$— groups. $R_{58}$ is a of identical in meaning to $R_{41}$. $R_{59}$ is a group of the same meaning as $R_{41}$; it is $R_{41}CON(R_{43})$— group, $R_{41}OCON(R_{43})$— group, $R_{41}SO_2N(R_{43})$— group, $R_{43}R_{44}NCON(R_{45})$— group, $R_{41}O$— group, $R_{41}S$— group, a halogen atom, or $R_{41}R_{43}N$— group. The notation of "d" is an integer ranging from 0 to 3. If d is 2 or 3, groups $R_{59}$ are substituent groups which are either identical or different, or can be bivalent groups combining together, forming a ring structure. Examples of the ring structure are for example pyridine ring and a pyrrole ring. $R_{60}$ and $R_{61}$ are groups of the same meaning as $R_{41}$. $R_{62}$ is a group of the same meaning as $R_{41}$; it is $R_{41}OCONH$— group, $R_{41}SO_2NH$— group, $R_{43}R_{44}NCON(R_{45})$— group, $R_{43}R_{44}NSO_2N(R_{45})$— group, $R_{43}O$— group, $R_{41}S$— group, a halogen atom, or $R_{41}R_{43}N$— group. $R_{63}$ is a group of the same meaning as $R_{41}$; it is $R_{43}CON(R_{45})$— group, $R_{43}R_{44}NCO$— group, $R_{41}SO_2N(R_{44})$— group, $R_{43}R_{44}NSO_2$— group, $R_{41}SO_2$— group, $R_{43}OCO$— group, $R_{43}O—SO_2$— group, a halogen atom, nitro group, cyano group, or $R_{43}CO$— group. The notation of "e" is an integer ranging from 0 to 4. In the case of any residual group having at least two $R_{62}$ or $R_{63}$, these groups are either identical or different. $R_{64}$ and $R_{65}$ are $R_{43}R_{44}NCO$— groups, $R_{41}CO$— groups, $R_{43}R_{44}NSO_2$— groups, $R_{41}OCO$— groups, $R_{41}SO_2$— groups, nitro groups, or cyano groups. $Z_1$ is a nitrogen atoms or $=C(R_{66})$— group, where $R_{66}$ is a group of the same meaning as $R_{63}$. $Z_2$ is a sulfur atom or an oxygen atom. The notation of "f" is either 0 or 1.

The aliphatic groups, mentioned above, are aliphatic hydrocarbon group which has 1 to 32 carbon atoms, preferably 1 to 22 carbon atoms, and are saturated or unsaturated, chain-like or ring-like, straight-chain or branched and substituted or unsubstituted. Typical examples of the aliphatic groups are: methyl, ethyl, propyl, isopropyl, butyl, (t)-butyl, (i)-butyl, (t)-amino, hexyl, cyclohexyl, 2-ethylhexyl, octyl, 1,1,3,3-tetramethylbutyl, decyl, dodecyl, hexadecyl, or octadecyl.

The aromatic groups are substituted or unsubstituted phenyl groups or substituted or unsubstituted naphthyl groups, which have 6 to 20 carbon atoms.

The heterocyclic groups are selected from those having 1 to 20 carbon atoms, more preferably 1 to 7 carbon atoms and having nitrogen atoms, oxygen atoms or sulfur atoms as hetero atoms. It is desirable that they be substituted or unsubstituted 3- to 8-membered heterocyclic groups. Typical examples of the heterocyclic groups are: 2-pyridyl, 2-furyl, 2-imidazolyl, 1-indolyl, 2,4-dioxo-1,3-imdazolidine-5-yl, 2-benzooxazolyl, 1,2,4-triazol-3-yl or 4-pyrazolyl.

Typical examples of the substituent group in case that the aliphatic hydrocarbon groups, the aromatic groups and the heterocyclic groups have the substituent groups are: a halogen atom, $R_{47}O$— group, $R_{46}S$— group, $R_{47}CON(R_{48})$— group, $R_{47}N(R_{48})CO$— group, $R_{46}OCON(R_{47})$— group, $R_{46}SO_2N(R_{47})$— group, $R_{47}R_{48}NSO_2$— group, $R_{46}SO_2$— group, $R_{47}OCO$— group, $R_{47}R_{48}NCON(R_{49})$— group, group of the same meaning as $R_{46}$, $R_{46}COO$— group, $R_{47}OSO_2$— group, cyano group, or nitro group. $R_{46}$ is aliphatic group, aromatic group, or heterocyclic group. $R_{47}$, $R_{48}$, and $R_{49}$ are aliphatic group, aromatic group, heterocyclic group, or a hydrogen atom. The aliphatic group, the aromatic group, and the hetero cyclic group of the meanings defined above.

Preferable ranges for $R_{51}$ to $R_{65}$, k, d, e, and f will be described.

Preferably, $R_{51}$ is aliphatic group or aromatic group, $R_{52}$ and $R_{55}$ are preferably aromatic groups, and $R_{53}$ is aromatic group or heterocyclic group.

In the general formula (Cp-3), $R_{54}$ is preferably $R_{41}CONH$— group or $R_{41}R_{43}N$— group, $R_{56}$ and $R_{57}$ are desirably aliphatic groups, aromatic groups, $R_{41}O$— groups, or $R_{41}S$— groups, and $R_{58}$ is preferably aliphatic group or aromatic group. In the general formula (Cp-6), $R_{59}$ is desirably a chlorine atom, aliphatic group, or $R_{41}CONH$— group, d is preferably 1 or 2, and $R_{60}$ is better aromatic group. In the general formula (Cp-7), $R_{59}$ is desirably $R_{41}CONH$-group, and d is better 1, $R_{61}$ is desirably aliphatic groups, aromatic groups. In the general formula (Cp-8), e is preferably 0 or 1, $R_{62}$ is desirably $R_{41}OCONH$— group, $R_{41}CONH$— group or $R_{41}SO_2NH$-group. These substituent is preferably located at position 5 of the naphthol ring. In the general formula (Cp-9), $R_{63}$ is preferably $R_{41}CONH$— group, $R_{41}SO_2NH$— group, $R_{41}R_{43}NSO_2$— group, $R_{41}SO_2$— group, $R_{41}R_{43}NCO$— group, nitro group or cyano group, and k is preferably 1 or 2. In the general formula (Cp-10), $R_{63}$ is desirably $(R_{43})$ 2 NCO— group, $R_{43}O$-CO— group or $R_{43}CO$— group, and k is preferably 1 or 2. In the general formula (Cp-11), $R_{54}$ is better aliphatic group, aromatic group, or $R_{41}CONH$— group, and f is preferably 1.

In the general formula (I), if $X_2$ is an oxygen atom or a sulfur atom, the group represented by $—X_1—W(=X_2)n_1—$ can be: $—OC(=O)_2—$, $—OC(=S)—$, $—SC(=O)—$, $—SC(=S)—$, $—OS(=O)—$, $—OS(=O)_2—$, and $—SS(=O)_2—$. If $X_2$ is the group $=NX_6$, $X_6$ is a hydrogen atom or a monovalent organic group. Desirable examples of this monovalent organic group are: alkyl group (e.g. methyl, isopropyl, butyl, isobutyl, tert-butyl, sec-butyl, neopentyl, hexyl, aryl group (e.g. phenyl), acyl group (e.g., acetyl, benzoyl), sulfonyl group (e.g., methanesulfonyl, benzenesulfonyl), carbamoyl group (e.g., ethylcarbamoyl, phenylcarbamoyl), sulfamoyl group (e.g., ethylsulfamoyl, phenylsulfamoyl), alkoxycarbonyl group (e.g., ethoxycarbonyl, butoxycarbonyl), aryloxycarbonyl group (e.g., phenoxycarbonyl, 4-methylphenoxycarbonyl), alkoxysulfonyl group (e.g., butoxysulfonyl, ethoxysulfonyl), aryloxysulfonyl group (e.g., phenoxysulfonyl, 4-methoxypheonoxysulfonyl), cyano group, nitro group, nitroso group, thioacyl group (e.g., thioacetyl, thiobenzoyl), thiocarbamoyl group (e.g., ethylthiocarbamoyl), imidoyl group (e.g., N-ethylimidoyl), amino group (e.g., amino, dimethylamino, methylamino), acylamino group (e.g., formylamino, acetylamino, N-methylacetylamino), alkoxy group (e.g., methoxy, isopropyloxy), or aryloxy group (e.g., phenoxy).

Any of the groups can have a substituent group, which is a group identified as $X_6$, a halogen atom (e.g., fluorine, chlorine, bromine), carboxyl group, or sulfo group.

Preferably, $X_2$ is an oxygen atom or a sulfur atom, and more preferably an oxygen atom.

Preferably as the $—X_1—W(=X_2)n_1—$ group is $—OC(=O)—$, $—OS(=O)—$, or $—OC(=S)—$, more preferably, $—OC(—O)—$ group.

Groups represented by $X_3$, $X_4$, and $X_5$ can be each a hydrogen atom or a monovalent organic group. In the case where $X_3$ and $X_4$ are both monovalent organic groups, the organic group is desirably alkyl group (e.g., methyl, ethyl) or aryl group (e.g., phenyl). It is also desirable that at least one of $X_3$ and $X_4$ be a hydrogen atom. It is more preferable that both $X_3$ and $X_4$ be hydrogen atoms.

$X_5$ is an organic group. Preferable examples of this organic group are: alkyl group (e.g., methyl, isopropyl, butyl, isobutyl, tert-butyl, sec-butyl, neopentyl, hexyl), aryl group (e.g., phenyl), acyl group (e.g., acetyl, benzoyl), sulfonyl group (e.g., methanesulfonyl, benzenesulfonyl), carbamoyl group (e.g., ethylcarbamoyl, phenylcarbamoyl), sulfamoyl group (e.g., ethylsulfamoyl, phenylsulfamoyl), alkoxycarbonyl group (e.g., ethoxycarbonyl, butoxycarbonyl), aryloxycarbonyl group (e.g., phenoxycarbonyl, 4-methylphenoxycarbonyl), alkoxysulfonyl group (e.g., butoxysulfonyl, ethoxysulfonyl), aryloxy sulfonyl group (e.g., phenoxysulfonyl, 4-methoxy phenoxysulfonyl), cyano group, nitro group, nitroso group, thioacyl group (e.g., thioacetyl, thio benzoyl), thiocarbamoyl group (e.g., ethylthio carbamoyl), imidoyl group (e.g., N-ethylimidoyl), amino group (e.g., amino, dimethylamino, methylamino), acylamino group (e.g., formylamino, acetylamino, N-methylacetylamino), alkoxy group (e.g., methoxy, isopropyloxy), or aryloxy group (e.g., phenoxy).

Any of the groups can have a substituent group, which is a group identified as $X_5$, a halogen atom (e.g., fluorine, chlorine, bromine), carboxyl group, or sulfo group.

Preferably, $X_5$ has 15 atoms or less, excluding the hydrogen atoms it has. It is also preferable that $X_5$ be substituted or nonsubstituted alkyl or aryl group. More preferably, it is substituted or nonsubstituted alkyl group.

Alternatively, two of groups represented by $X_3$, $X_4$ and $X_5$ can be bivalent and bond together, forming a ring. The ring, thus formed, may preferably be four- to eight-members. More preferably, it is four-membered to six-membered. Desirable examples of the bivalent groups are: $-C(=O)-N(X_7)-$, $-SO_2-N(X_7)-$, $-(CH_2)_3-$, $-(CH_2)_4-$, $-(CH_2)_5-$, $-C(=O)-(CH_2)_2-$, $-C(=O)-N(X_7)-C(=O)-$, $-SO_2-N(X_7)-C(=O)-$, $-C(=O)-C(X_7)(X_8)-$, and $-(CH_2)_2-O-CH_2-$.

Here, $X_7$ and $X_8$ are of the same meaning that a hydrogen atom or $X_5$ is a monovalent organic group. $X_7$and $X_8$ can be either identical or different.

The residual groups of $X_3$, $X_4$, $X_5$ which is not a bivalent group is a hydrogen atoms or a monovalent organic group. Specific examples of the organic group are identical to the above-mentioned examples of $x_3$, $x_4$, $X_5$which do not form a ring.

In the case where two of $X_3$, $X_4$, $X_5$ bond together, forming a ring, it is desirable that $X_3$ or $X_4$ be a hydrogen atom and that residual $X_3$ or $X_4$ and $X_5$ bond, forming the ring. More preferably, the bivalent groups have their left ends coupled to the hydrogen atom of the general formula (I), and their right ends coupled to the carbon atom of the general formula (I).

Still alternatively, none of groups $x_3$, $X_4$ and $X_5$form no rings at all, and are each a hydrogen atom or a monovalent organic group.

In the general formula (I), $n_2$ is 1 or 2, preferably 1.

Also in the general formula (I), the formula weight of all bivalent groups, except groups represented by A and PUG, is preferably 240 or less, more preferably 200 or less, still more preferably 180 or less.

The photographically useful group, represented as PUG in the formula (I), is an development restrainer, for example, a dye, a fogging agent, a developing agent, a coupler, a bleaching accelerator, or a fixing accelerator. Examples of the photographically useful group are the group disclosed in U.S. Pat. No. 4,248,962 (i.e., the group represented by general formula PUG in the patent), the dye disclosed in JP-A-62-49353 (i.e., the coupling split-off group released from a coupler in the specification), the development restrainer described in U.S. Pat. No. 4,477,563, and the bleaching accelerators disclosed in JP-A-61-201247 and JP-A-2-55 (i.e., the coupling split-off groups released from couplers in the specification). In the present invention, particularly preferable as photographically useful group is a restrainer.

Preferable examples of the development restrainer are the groups represented by the following formulas (INH-1) to (INH-13):

(INH-1)

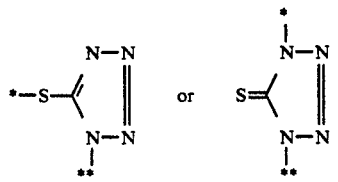

(INH-2)

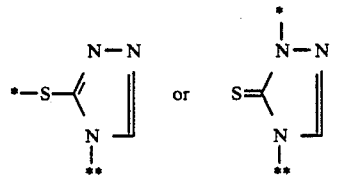

(INH-3)

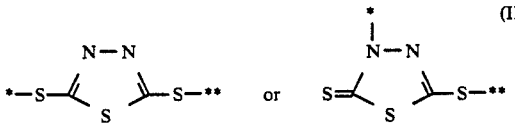

(INH-4)

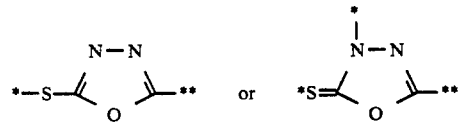

(INH-5)

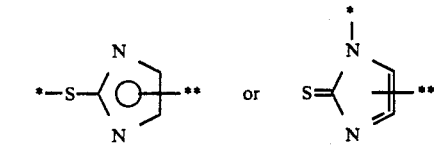

(INH-6)

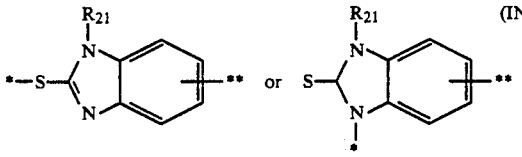

wherein $R_{21}$ is hydrogen atom, or substituted or unsubstituted hydrocarbon group (e.g. methyl, ethyl, propyl, phenyl)

(INH-7)

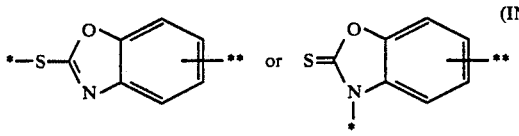

-continued (INH-8)

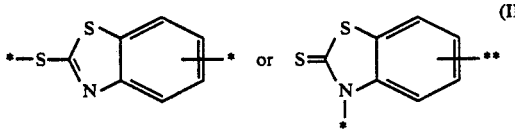

(INH-9)

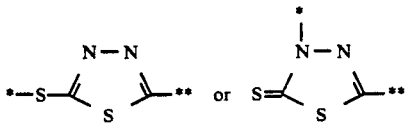

(INH-10)

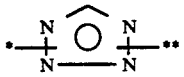

(INH-11)

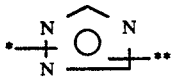

(INH-12)

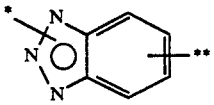

(INH-13)

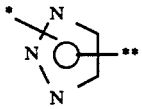

In the formulas, the mark * indicates the position which is bonded to the residual group except PUG shown in the general formula (I), and the mark ** indicates the position which is bonded to the substituent group. The substituent group can be aliphatic group, aryl group, or heterocyclic group.

More specifically, examples of the aliphatic group are: alkoxycarbonyl group (e.g., ethoxycarbonyl, 1,4-dioxo-2,5-dioxadecyl, 1,4-dioxo-2,5-dioxa-8-methylnonyl), aryloxycarbonyl group (e.g., phenoxy carbonyl), alkylthio group (e.g., methylthio, propylthio), alkoxy group (e.g., methoxy, proplyloxy), sulfonyl group (e.g., methanesulfonyl), carbamoyl group (e.g., ethylcarbamoyl), sulfamoyl group (e.g., ethyl sulfamoyl), cyano group, nitro group, acylamino group (e.g., acetylamino), alkyl group (e.g., methyl, ethyl, propyl, butyl, hexyl, decyl, isobutyl, t-butyl, 2-ethylhexyl, benzyl, 4-methoxybenzyl, phenethyl, propyl oxycarbonylmethyl, 2-(propyloxycarbonyl)ethyl, butyl oxycarbonylmethyl, pentyloxycarbonylmethyl, 2-cyano ethyloxy carbonylmethyl, 2,2-dichloroethyloxy carbonyl methyl, 3-nitropropyloxy carbonylmethyl, 4-nitrobenzyloxy carbonylmethyl, or 2,5-dioxo-3,6-dioxadecyl).

Specific examples of the aryl group are: for example, phenyl, naphthyl, 4-methoxycarbonylphenyl, 4-ethoxycarbonylphenyl, and 3-methoxycarbonylphenyl, 4-(2-cyanoethyloxycarbonyl)-phenyl.

Specific examples of the heterocyclic group are: for example 4-pyridyl, 3-pyridyl, 2-pyridyl, 2-furyl, and 2-tetrahydropyranyl.

Preferable examples of the substituent group is substituted or unsubstituted alkoxycarbonyl group, substituted or unsubstituted aryloxycarbonyl group, substituted or unsubstituted alkyl group, substituted or unsubstituted aryl group. More preferably are alkoxycarbonyl group having substituent groups, unsubstituent alkyl group having 2 to 7 carbon atoms, alkyl group substituted by alkoxycarbonyl group, substituted alkyl group having 2 to 10 carbon atoms, and substituted or unsubstituted phenyl group.

Of the INH, preferable are (INH-1, (INH-2), (INH-3), (INH-4), (INH-9) and (INH-12). (INH-1), (INH-2), (INH-3) are desirable in particular.

Specific examples of the compounds used in the present invention are shown as follows. Nonetheless, the invention is not limited to the use of these specific examples.

(1)

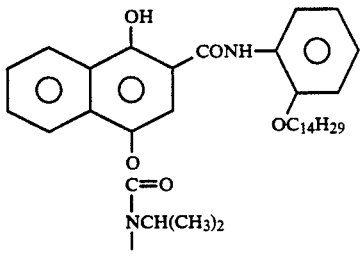

(2)

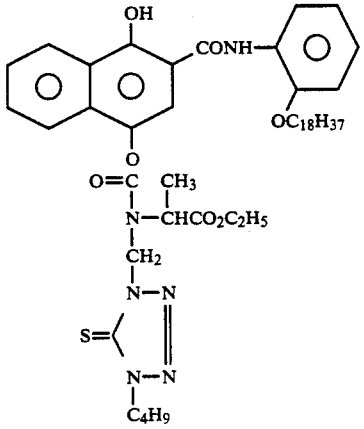

-continued
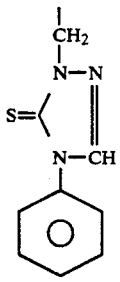
(3)
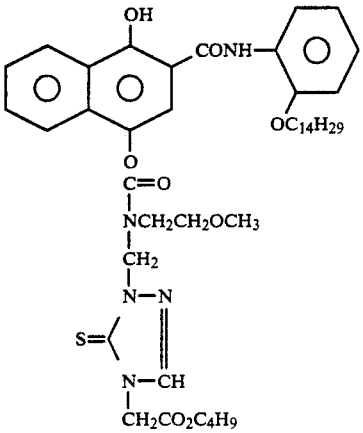
(4)
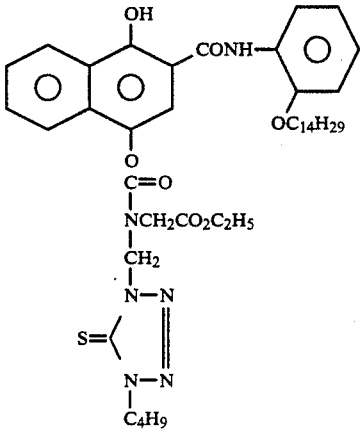
(5)
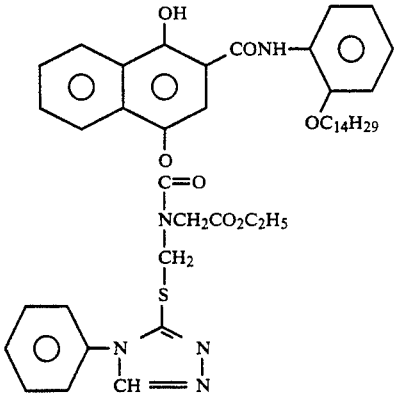
(6)
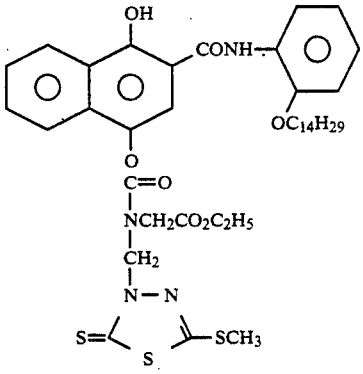
(7)
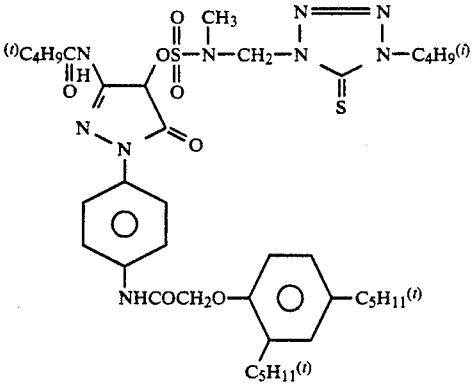
(8)
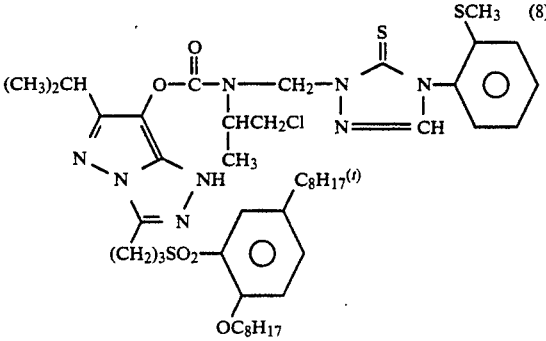

-continued
(9)
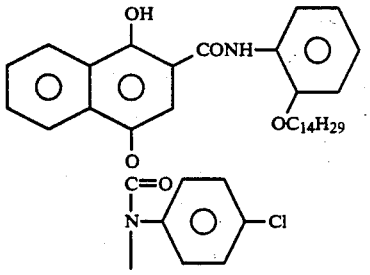
(10)
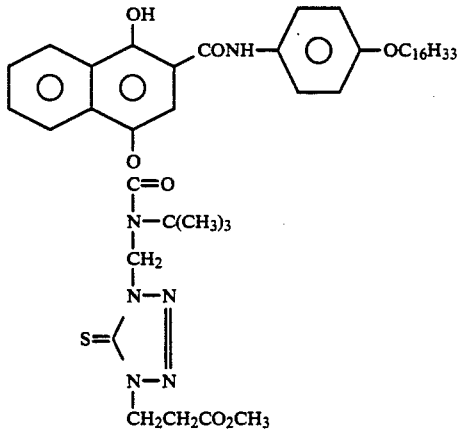
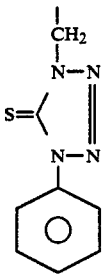
(11)
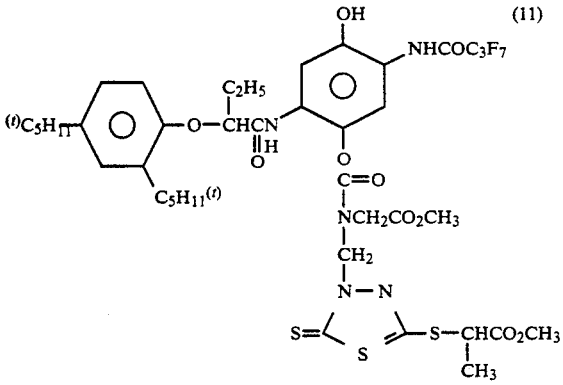
(12)
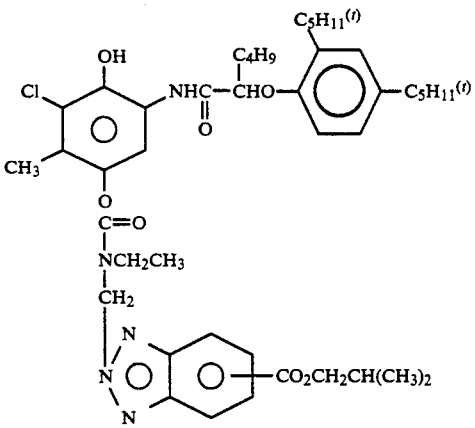
(13)
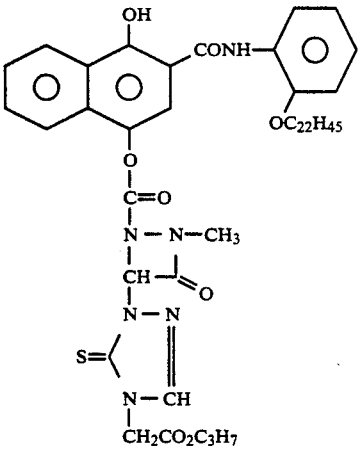
(14)
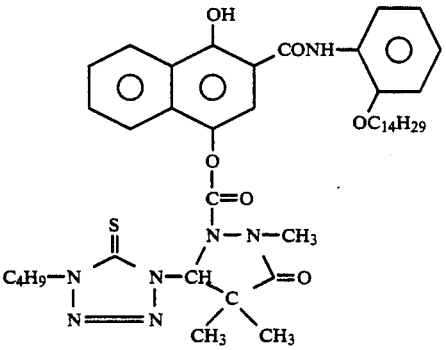

-continued
(15)
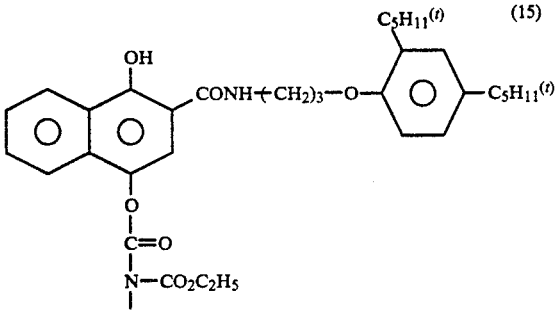
(16)
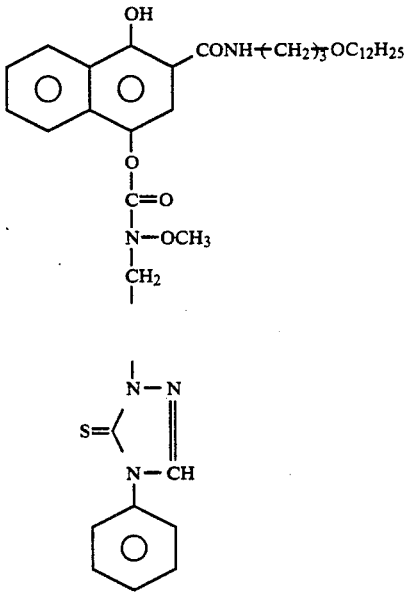
(17)
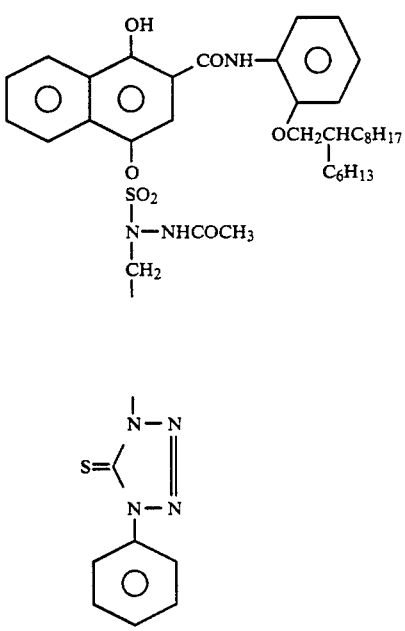
(18)
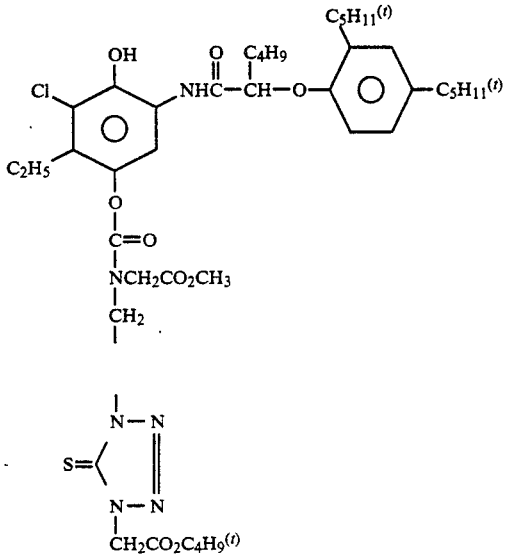
(19)
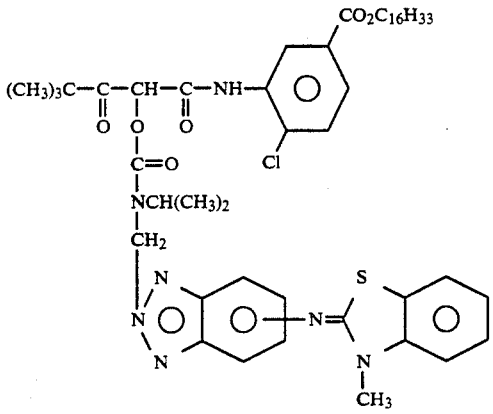

-continued
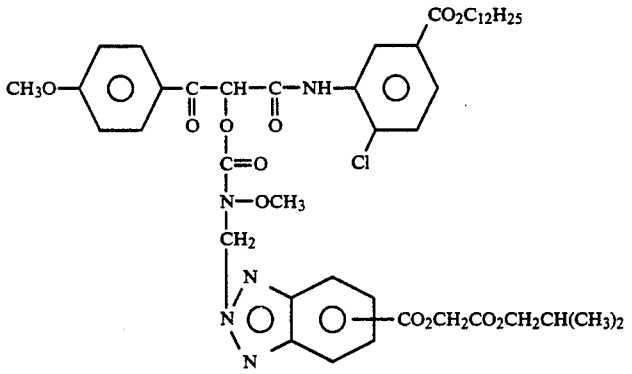
(20)
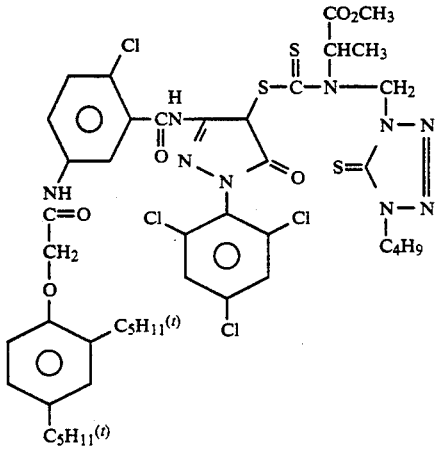
(21)
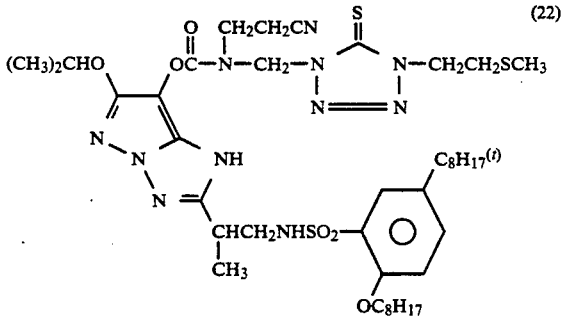
(22)
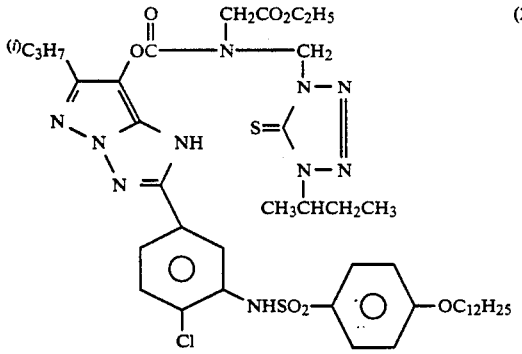
(23)
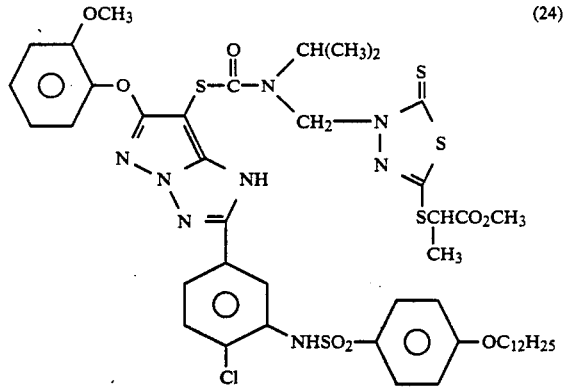
(24)
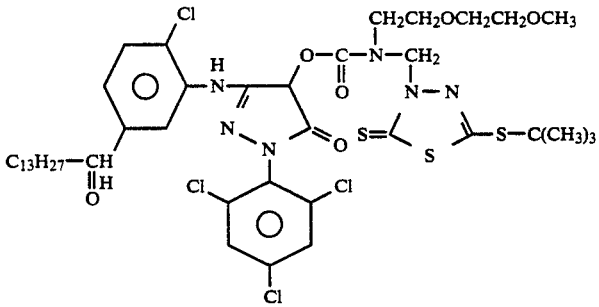
(25)

-continued
(26)
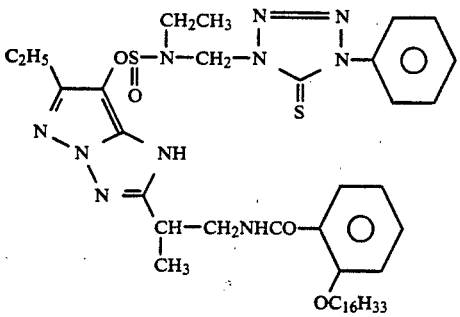
(27)
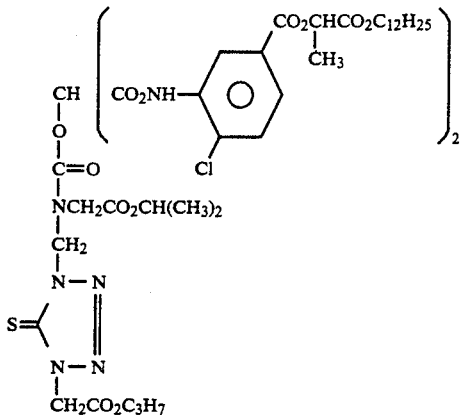
(28)
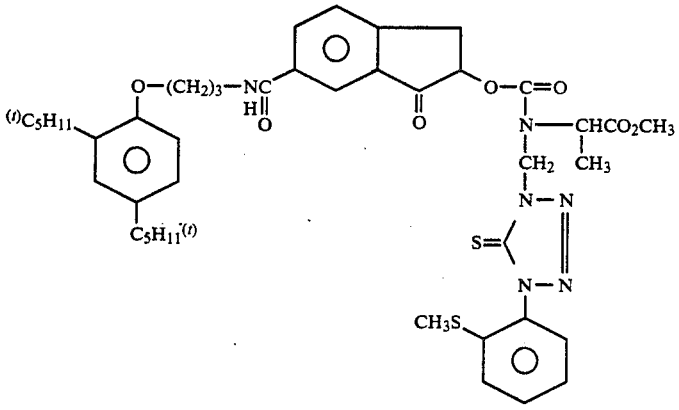
(29)
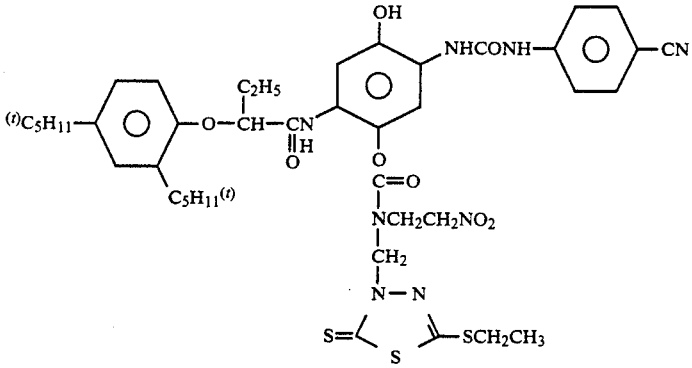
(30)
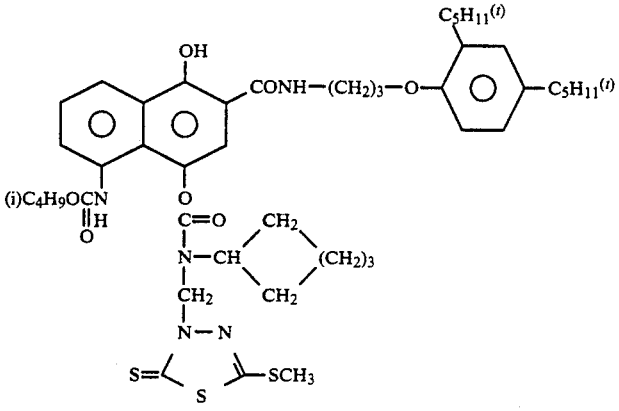

-continued
(31)
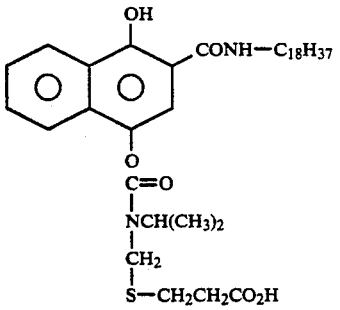
(32)
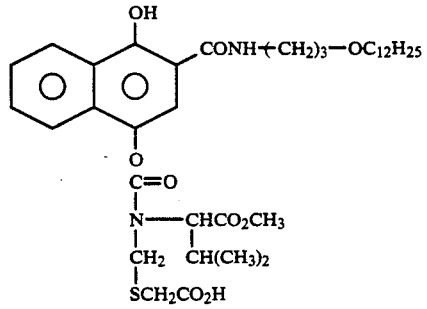
(33)
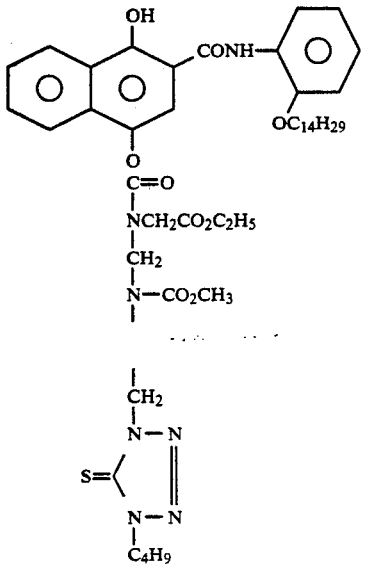
(34)
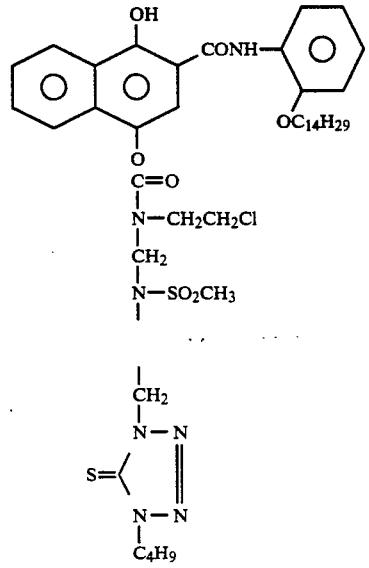
(35)
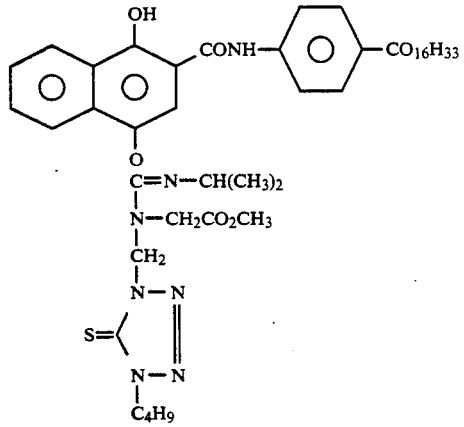
(36)
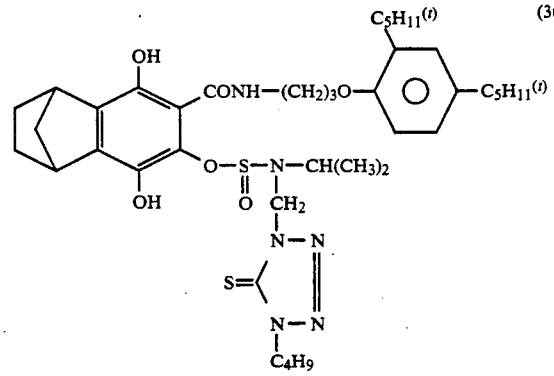
The compounds of the invention can be synthesized by various methods, one of which is disclosed in JP-A-60-218645. Two synthesis routes, i.e., Scheme 2 and Scheme 3, are available.
Scheme 2

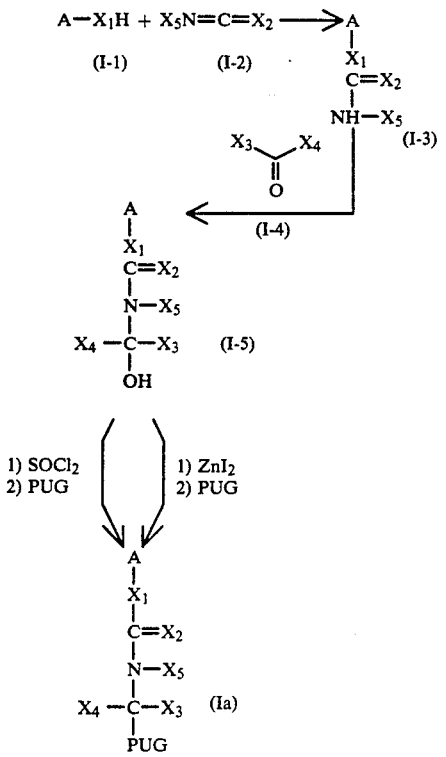

(A, $X_1$ to $X_5$, and PUG are identical in meaning to those in the formula (I).

In Scheme 2, the intermediate product (I-5) is treated with thionyl chloride and then reacted with PUG in the presence of a base, thereby preparing a final product (Ia). Alternatively, the intermediate product (I-5) is reacted with PUG in the presence of $ZnI_2$, thereby preparing a final product (Ia). The products (Ia) in these alternative processes are in some cases not identical but are isomers. For instance, when a development restrainer is used as PUG, the restrainer can bond with a sulfur atom or a nitrogen atom, as may be understood from the formula (INH-1). Whichever isomer (Ia) can be prepared, merely by selecting the desired alternative synthetic process.

Scheme 3

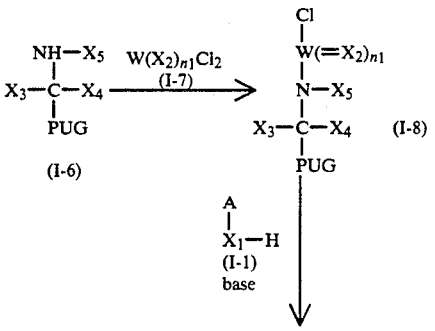

-continued

Scheme 3

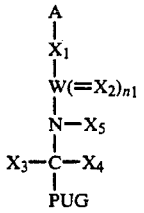

(I)

(A, $X_1$ to $X_5$, W, $n_1$ and PUG are identical in meaning to those in the formula (I).)

Examples of method for synthesizing the compounds according to the invention will now be described.

(Synthesis 1)—Synthesis of Compound (1)

First, 200 g of (1-a) in Scheme 4 and 34.7 g of (1-b) in Scheme 4 were dissolved in 500 ml of ethyl acetate, thus forming a solution. Then, 142 ml of diisopropylethylamine was added to the solution, and the resultant mixture was stirred for 4 hours. The precipitated crystals were filtered out and washed with ethyl acetate. As a result, 176 g of (1-c) in Scheme 4 was obtained (yield: 75%).

Scheme 4

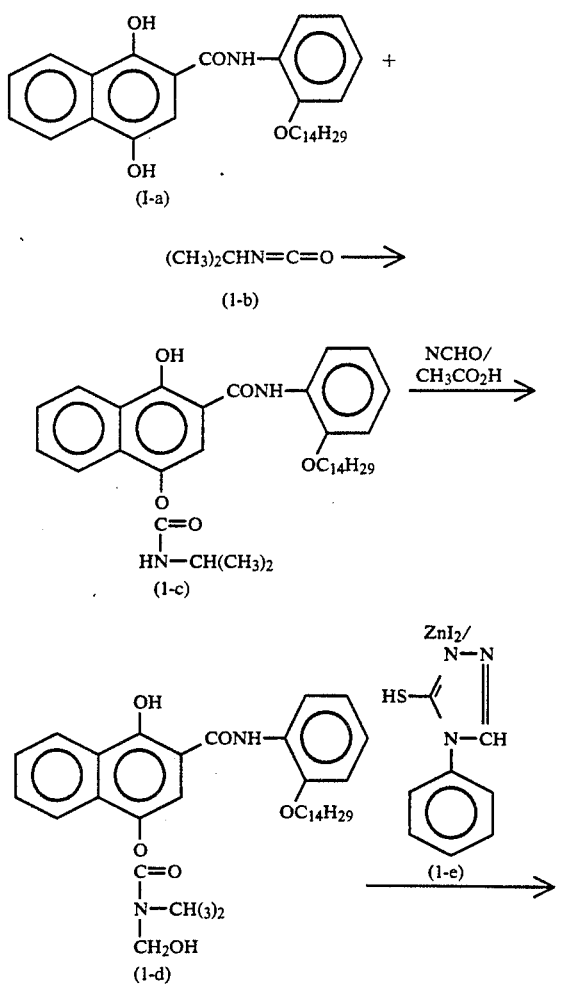

-continued
Scheme 4

Compound (1)

Next, 53.6 g of (1-c) in Scheme 4 was reacted with paraformaldehyde (27.9 g) under reflux for 4 hours in a mixture of 1,2-dichloroethane (500 ml) and acetic acid (54 ml), thus forming a reaction product. This product was cooled to room temperature, washed with water, dried with anhydrous sodium sulfate and condensed. The resultant residue was refined by silica gel column chromatography using chloroform as eluent. As a result, 23.2 g of (1-d) in Scheme 4 was prepared (yield: 41.2%).

Thereafter, 23.2 g of (1-d) and 6.78 g of (1-1) were dissolved in chloroform (250 ml), thus preparing a solution. Then, 26.88 g of zinc iodide was added to the solution, and the resultant mixture was stirred for 3 hours. 1N acetic acid was added to the mixture thus mixture, forming a reaction liquid. Next, the reaction liquid was washed with water, whereby an organic layer was obtained. The organic layer was dried and condensed with anhydrous sodium sulfate. The resultant residue was refined by means-silica gel column chromatography (the ethyl acetate-hexane ratio being 1:4). As a result, the illustrated compound (1) was obtained in the amount of 7.0 g (yield: 23.9%). This compound exhibited a melting point ranging 117.0° to 118.5° C.

(Synthesis 2)—Synthesis of illustrated Compound (4)

The compound (4) was synthesized in the same way as in Synthesis 1. The compound (4), thus prepared, exhibited a melting point ranging from 61.5° to 63.0° C.

(Synthesis 3)—Synthesis of illustrated Compound (5)

The compound (5) was synthesized in the same way as in Synthesis 1. The compound (5), thus prepared, had a melting point ranging from 95.5° to 96.5° C.

(Synthesis 4)—Synthesis of illustrated Compound (6)

The compound (6) was synthesized in the same way as in Synthesis 1. The compound (6) had a melting point ranging from 63.5° to 66.0° C.

(Synthesis 5)—Synthesis of illustrated Compound (9)

The compound (9) was synthesized in the same way as in Synthesis 1. The compound (9), thus prepared, exhibited a melting point ranging from 146.0° to 148.0° C.

The light-sensitive material of the present invention need only have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one light-sensitive layers constituted by a plurality of silver halide emulsion layers which are sensitive to essentially the same color sensitivity but has different light sensitivity. The light-sensitive layers are unit light-sensitive layer sensitive to blue, green or red. In a multilayered silver halide color photographic light-sensitive material, the unit light-sensitive layers are generally arranged such that red-, green-, and blue-sensitive layers are formed from a support side in the order named. However, this order may be reversed or a layer sensitive to one color may be sandwiched between layers sensitive to another color in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing preventing agent which is normally used.

As a plurality of silver halide emulsion layers constituting each unit light-sensitive layer, a two-layered structure of high- and low-sensitivity emulsion layers can be preferably used as described in West German Patent 1,121,470 or British Patent 923,045. In this case, layers are preferably arranged such that the sensitivity is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-sensitivity emulsion layer is formed remotely from a support and a high-sensitivity layer is formed close to the support.

More specifically, layers may be arranged from the farthest side from a support in an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), an order of BH/BL/GL/GH/RH/RL, or an order of BH/BL/GH/GL/RL/RH.

In addition, as described in JP-B-55-34932 ("JP-B" means Published Examined Japanese Patent Application, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in an order of medium-sensitivity emulsion layer/high-sensitivity emulsion layer/low-sensitivity emulsion layer from the farthest side from a support in one sensitive layer as described in JP-A-59-202464.

In addition, an order of high-sensitivity emulsion layer/low-sensitivity emulsion layer/medium-sensitivity emulsion layer or low-sensitivity emulsion layer/medium-sensitivity emulsion layer/high-sensitivity emulsion layer may be adopted.

Furthermore, the arrangement can be changed as described above even when four or more layers are formed.

To improve the color reproducibility, a donor layer (CL) can be arranged adjacent to, a major light-sensitive layer BL, GL or RL. The donor layer having an interimage effect should have a spectral sensitivity distribution which is different from that of the major light-sensitive layer. Donor layers of this type are disclosed in U.S. Pat. Nos. 4,663,271, 4,705,744, 4,707,436, JP-A-62-160448, and JP-A-63-89850.

As described above, various layer constructions and arrangements can be selected in accordance with the application of the light-sensitive material.

A preferable silver halide contained in photographic emulsion layers of the photographic light-sensitive material of the present invention is silver bromoidiode, silver chloroiodide, or silver chlorobromoiodide containing about 30 mol % or less of silver iodide. The most preferable silver halide is silver bromoiodide or silver chlorobromoiodide containing about 2 mol % to about 10 mol % of silver iodide.

Silver halide grains contained in the photographic emulsion may have regular crystals such as cubic, octahedral, or tetradecahedral crystals, irregular crystals such as spherical or tabular crystals, crystals having crystal defects such as twinned crystal planes, or composite shapes thereof.

The silver halide may consist of fine grains having a grain size of about 0.2 μm or less or large grains having a projected area diameter of about 10 μm, and the emulsion may be either a poly-dispersed or mono-dispersed emulsion.

The silver halide photographic emulsion which can be used in the present invention can be prepared by methods described in, for example, Research Disclosure (RD) No. 17,643 (December, 1978), pp. 22 to 23, "I. Emulsion preparation and types", RD No. 18,716 (November, 1979), page 648, and RD No. 307,105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394 and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226, 4,414,310, 4,433,048, and 4,439,520, and British Patent 2,112,157.

The crystal structure may be uniform, may have different halogen compositions in the interior and the surface layer thereof, or may be a layered structure. Alternatively, a silver halide having a different composition may be bonded by an epitaxial junction or a compound except for a silver halide such as silver rhodanide or lead oxide may be bonded. A mixture of grains having various types of crystal shapes may be used.

The above emulsion may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. When the emulsion is of an internal latent image type, it may be a core/shell internal latent image type emulsion described in JP-A-63-264740. A method of preparing this core/shell internal latent image type emulsion is described in JP-A-59-133542. Although the thickness of a shell of this emulsion changes in accordance with development or the like, it is preferably 3 to 40 nm, and most preferably, 5 to 20 nm.

A silver halide emulsion is normally subjected to physical ripening, chemical ripening, and spectral sensitization steps before it is used. Additives for use in these steps are described in Research Disclosure Nos. 17,643, 18,716, and 307,105 and they are summarized in the following table.

In the light-sensitive material of the present invention, two or more types of emulsions different in at least one characteristic of a grain size, a grain size distribution, a halogen composition, a grain shape, and sensitivity can be mixed in one layer.

A surface-fogged silver halide grain described in U.S. Pat. No. 4,082,553, an internally fogged silver halide grain described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed in either a non-exposed portion or an exposed portion of the light-sensitive material. A method of preparing the internally fogged or surface-fogged silver halide grain is described in U.S. Pat. No. 4,626,498 or JP-A-59-214852.

A silver halide which forms the core of an internally fogged core/shell type silver halide grain may have the same halogen composition as or a different halogen composition from that of the other portion. Examples of the internally fogged or surface-fogged silver halide are silver chloride, silver bromochloride, silver bromoiodide, and silver iodofromochloride. Although the grain size of these fogged silver halide grains is not particularly limited, an average grain size is 0.01 to 0.75 μm, and most preferably, 0.05 to 0.6 μm. The grain shape is also not particularly limited but may be a regular grain shape. Although the emulsion may be a polydisperse emulsion, it is preferably a monodisperse emulsion (in which at least 95% in weight or number of silver halide grains have a grain size falling within the range of ±40% of an average grain size).

In the present invention, a non-light-sensitive fine silver halide grain is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of diameter taken as the diameter of a circle which has the same area as the projected area of the grain) of the fine grain silver halide is preferably 0.01 to 0.5 μm, and more preferably, 0.02 to 0.2 μm.

The fine grain silver halide can be prepared by a method similar to a method of preparing normal light-sensitive silver halide. In this preparation, the surface of a silver halide grain need not be subjected to either optical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain containing layer preferably contains a colloidal silver.

The silver coverage is preferably 6.0 g/m$^2$ or less, and most preferably, 4.5 g/m$^2$ or less.

Known photographic additives usable in the present invention are also described in the above three RDs, and they are summarized in the following Table I:

TABLE I

| Additives | RD17643 | RD18716 | RD307105 |
|---|---|---|---|
| 1. Chemical sensitizers | page 23 | page 648, right column | page 866 |
| 2. Sensitivity increasing agents | | page 648, right column | |
| 3. Spectral sensitizers, super sensitizers | pp. 23–24 | page 648, right column to page 649, right column | pp. 866–868 |
| 4. Brighteners | page 24 | page 647, right column | page 868 |
| 5. Antifoggants and stabilizers | pp. 24–25 | page 649. right column | pp. 868–870 |
| 6. Light absorbent. filter dye. ultra-violet absorbents | pp. 25–26 | page 649, right column to page 650. left column | page 873 |
| 7. Stain preventing agents | page 25, right column | page 650. left to right columns | page 872 |
| 8. Dye image stabilizer | page 25 | page 650, left column | page 872 |
| 9. Hardening agents | page 26 | page 651. left column | pp. 874–875 |
| 10. Binder | page 26 | page 651. left column | pp. 873–874 |
| 11. Plasticizers. lubricants | page 27 | page 650, right column | page 876 |
| 12. Coating aids. surface active agents | pp. 26–27 | page 650, right column | pp. 875–876 |
| 13. Antistatic agents | page 27 | page 650, right column | pp. 876–877 |
| 14. Matting agent | | | pp. 878–879 |

In order to prevent degradation in photographic properties caused by formaldehyde gas, a compound which can react with and fix formaldehyde described in U.S. Pat. Nos. 4,411,987 or 4,435,503 is preferably added to the light-sensitive material.

The light-sensitive material of the present invention preferably contains mercapto compounds described in U.S. Pat. Nos. 4,740,454 and 4,788,132, JP-A-62-18539, and JP-A-1-283551.

The light-sensitive material of the present invention preferably contains compounds for releasing a fogging agent, a development accelerator, a silver halide solvent, or precursors thereof described in JP-A-1-106052 regardless of a developed silver amount produced by the development.

The light-sensitive material of the present invention preferably contains dyes dispersed by methods described in WO 88/04794 and JP-A-1-502912 or dyes described in EP 317,308A, U.S. Pat. No. 4,420,555, and JP-A-1-259358.

Various color couplers can be used in the present invention, and specific examples of these couplers are described in patents described in above-mentioned Research Disclosure (RD), No. 17643, VII-C to VII-G and RD No. 307105, VII-C to VII-G.

Preferred examples of a yellow coupler are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of a magenta coupler are preferably 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and WO 88/04795.

Examples of a cyan coupler are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, German Patent Application 3,329,729, EP 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658. Also, the pyrazoloazole couplers disclosed in JP-A-64-553, JP-A-64-554, JP-A-64-555 and JP-A-64-556, and imidazole-series couplers disclosed in U.S. Pat. No. 4,818,672 can be used as cyan coupler in the present invention.

Typical examples of a polymerized dye-forming coupler are described in U.S. Pat. Nos. 3,451,820, 4,080,211, 4,367,282, 4,409,320, and 4,576,910, British Patent 2,102,173, and EP 341,188A.

Preferable examples of a coupler containing colored dyes having a suitable degree of diffusibility are those described in U.S. Pat. No. 4,366,237, British Patent 2,125,570, EP 96,570, and German Patent Application (OLS) No. 3,234,533.

Preferable examples of a colored coupler for correcting additional, undesirable absorption of a colored dye are those described in R.D No. 17643, VII-G, R.D. No. 307105, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a coupling split-off group described in U.S. Pat. No. 4,777,120 may be preferably used.

Couplers releasing a photographically useful residue upon coupling are preferably used in the present invention. DIR couplers, i.e., couplers releasing a development restrainer are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012 otherwise represented general formula (I) of present invention.

Research Disclosures Nos. 11449 and 24241, JP-A-61-201247, and the like disclose couplers which release breaching accelerator. These couplers effectively serve to shorten the time of any process that involves breaching. They are effective, particularly when added to light-sensitive material containing tabular silver halide grains. Preferable examples of a coupler for imagewise releasing a nucleating agent or a development accelerator in development are described in British Patents 2,097,140 and 2,131,188, JP-A-59-157638, and JP-A-59-170840. In addition, compounds for releasing a fogging agent, a development accelerator, or a silver halide solvent upon redox reaction with an oxidation product of a developing agent, described in JP-A-60-107029, JP-A-60-252340, JP-A-1-44940, and JP-A-1-45687, can also be preferably used.

Examples of a compound which can be used in the light-sensitive material of the present invention are competing couplers described in, e.g., U.S. Pat. No. 4,130,427; multi-equivalent couplers described in, e.g., U.S. Pat. Nos. 4,283,472, 4,338,393, and 4,310,618; a DIR redox compound releasing coupler, a DIR releasing coupler, a DIR coupler releasing redox compound, or a DIR redox releasing redox compound described in, e.g., JP-A-60-185950 and JP-A-62-24252; couplers releasing a dye in which the color is restored after elimination described in EP 173,302A and 313,308A; a legand releasing coupler described in, e.g., U.S. Pat. No. 4,555,477; a coupler releasing a leuco dye described in JP-A-63-75747; and a coupler releasing a fluorescent dye described in U.S. Pat. No. 4,774,181.

The couplers for use in this invention can be added to the light-sensitive material by various known dispersion methods.

Examples of a high-boiling organic solvent to be used in the oil-in-water dispersion method are described in e.g. U.S. Pat. No. 2,322,027. Examples of a high-boiling organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-diethylpropyl) phthalate), phosphoric esters or phosphonic esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoic esters (e.g., 2-ethylhexylbenzoate, dodecylbenzoate, and 2-ethylhexyl-p-hydroxybenzoate), amides (e.g., N,N-diethyldodecaneamide, N,N-diethyl laurylamide, and N-tetradecylpyrrolidone), alcohols or phenols (e.g., isostearylalcohol and 2,4-di-tert-amylphenol), aliphatic carboxylic esters (e.g., bis(2-ethylhexyl) sebacate, dioctylazelate, glyceroltri butylate, isostearyllactate, and trioctylcitrate), an aniline derivative (e.g., N,N-dibutyl-2-butoxy-5-tert-octylaniline), and hydrocarbons (e.g., paraffin, dodecylbenzene, and disopropylnaphthalene). An organic solvent having a boiling point of about 30° C. or more, and preferably, 50° C. to about 160° C. can be used as a co-solvent. Typical examples of the co-solvent are ethyl acetate, butyl acetate, ethyl propionate, methylethylketone, cyclohexanone, 2-ethoxyethylacetate, and dimethylformamide.

Steps and effects of a latex dispersion method and examples of a loadable latex are described in, e.g., U.S. Pat. Nos. 4,199,363 and German Patent Application (OLS) Nos. 2,541,274 and 2,541,230.

Various types of an antiseptic agent or a mildewproofing agent are preferably added to the color light-sensitive material of the present invention. Examples of the antiseptic agent and the mildewproofing agent are phenethyl alcohol or 1,2-benzisothiazoline-3-on, n-butyl-p-hydroxybenzoate, phenol, 4-chloro-3,5-dimethylphenol, 2-phenoxyethanol, and 2-(4-thiazolyl) benzimidazole described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, color paper, a color positive film, and color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{\frac{1}{2}}$ is preferably 30 sec. or less, and more preferably, 20 sec. or less. The film thickness means a film thickness measured under moisture conditioning at a temperature of 25° C. and a relative humidity of 55% (two days). The film swell speed $T_{\frac{1}{2}}$ can be measured in accordance with a known method in the art. For example, the film swell speed $T_{\frac{1}{2}}$ can be measured by using a swell meter described in Photographic Science & Engineering, A. Green et al., Vol. 19, No. 2, pp. 124 to 129. When 90% of a maximum swell film thickness reached by performing a treatment by using a color developing agent at 30° C. for 3 min. and 15 sec. is defined as a saturated film thickness, $T_{\frac{1}{2}}$ is defined as a time required for reaching ½ of the saturated film thickness.

The film swell speed $T_{\frac{1}{2}}$ can be adjusted by adding a film hardener to gelatin as a binder or changing aging conditions after coating. A swell ratio is preferably 150% to 400%. The swell ratio is calculated from the maximum swell film thickness measured under the above conditions in accordance with a relation: (maximum swell film thickness−film thickness)/film thickness.

In the light-sensitive material of the present invention, hydrophilic colloid layers (called back layers) having a total dried film thickness of 2 to 20 m are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine-based color developing agent. As the color developing agent, although an aminophenol-based compound is effective, a p-phenylenediamine-based compound is preferably used. Typical examples of the p-phenylenediamine-based compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates thereof. Of these compounds, 3-methyl-4-amino-N-ethyl-N-β-hydroxyethylaniline sulfate is most preferred. These compounds can be used in a combination of two or more thereof in accordance with the application.

In general, the color developer contains a pH buffering agent such as a carbonate, a borate, or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-bis-carboxymethylhydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylene diamine-di(o-hydroxyphenylacetic acid), and salts thereof.

In order to perform reversal process, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenol such as N-methyl-p-aminophenol can be singly or in a combination of two or more thereof. The pH of the color and black-and-white developers is generally 9 to 12. Although a replenishment amount of the developer depends on a color photographic light-sensitive material to be processed, it is generally 3 liters or less per $m^2$ of the light-sensitive material. The replenishment amount can be decreased to be 500 ml or less by decreasing a bromide ion concentration in a replenishing solution. In order to decrease the replenishment amount, a contact area of a processing tank with air is preferably decreased to prevent evaporation and oxidation of the solution upon contact with air.

The contact area between solution and air in a processing tank can be represented by an aperture defined below: Aperture = [contact area ($cm^2$) between processing solution and air]/[volume ($cm^3$) of processing solution].

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, a replenishing amount can be reduced by using a means of suppressing storage of bromide ions in the developing solution.

A color development time is normally two to five minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are a compound of a multivalent metal, e.g., iron(III), peroxides; quinones; and a nitro compound. Typical examples of the bleaching agent are an organic complex salt of iron(III), e.g., a complex salt of an aminopolycarboxylic acid such as ethylenediaminetetraacetic acid, diethylenetriaminepentaacetic acid, cyclohexanediamine-tetraacetic acid, methyliminodiacetic acid, 1,3-diaminopropanetetraacetic acid, and glycoletherdiaminetetraacetic acid; or a complex salt of citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfide group described in, e.g., U.S. Pat. No. 3,893,858, German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, and JP-A-53-141623, and JP-A-53-28426, and Research Disclosure No. 17,129 (July, 1978); a thiazolidine derivative described in JP-A-50-140129; thiourea derivative described in JP-B-45-8506, JP-A-52-20832, JP-A-53-32735, and U.S. Pat. No. 3,706,561 iodide salts described in German Patent 1,127,715 and JP-A-58-16235; polyoxyethylene compounds descried in German Patents 966,410 and 2,748,430; a polyamine compound described in JP-B-45-8836; compounds descried in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid, or hydroxyacetic acid.

Examples of the fixing agent are thiosulfate, a thiocyanate, a thioether-based compound, a thiourea and a large amount of an iodide. Of these compounds, a thiosulfate, especially, ammonium thiosulfate can be used in the widest range of applications. In addition, a combination of thiosulfate and a thiocyanate, a thioether-based compound, or thiourea is preferably used. As a preservative of the bleach-fixing solution, a sulfite, a bisulfite, a carbonyl bisulfite adduct, or a sulfinic acid compound described in EP 294,769A is preferred. In addition, in order to stabilize the fixing solution or the bleach-fixing solution, various types of aminopolycarboxylic acids or organic phosphonic acids are preferably added to the solution.

In the present invention, 0.1 to 10 mol/l of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering failure occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of strengthening the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. Furthermore, the aforementioned means of increasing agitation are more effective in cases where a bleaching accelerator is being used, and they sometimes provide a marked increase in the accelerating effect and eliminate the fixer inhibiting action of the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces a processing solution replenishing amount.

The silver halide color photographic light-sensitive material of the present invention is normally subjected to washing and/or stabilizing steps after desilvering. An amount of water used in the washing step can be arbitrarily determined over a broad range in accordance with the properties (e.g., depending on material such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current system can be obtained by a method described in "Journal of the Society of Motion Picture and Television Engineering", Vol. 64, PP. 248–253 (May, 1955). In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, an isothiazolone compound and cyabendazole described in JP-A-57-8542, a chlorine-based germicide such as chlorinated sodium isocyanurate, benzotriazole and germicides described in Hiroshi Horiguchi et al., "Chemistry of Biocides and Fungicides", (1986), Sankyo Shuppan, EiseigiJutsu-Kai ed., "Killing, Microorganisms, Biocides, and Fungicidal Techniques", (1982), KogyogiJutsu-Kai, and Nippon Bokin Bokabi Gakkai ed., "A Dictionary of Biocides and Fungicides", (1986), can be used.

The pH of the water for washing the light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing bath in place of washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are an aldehyde such as formalin and glutaraldehyde, an N-methylol compound, hexamethylenetetramine, and an aldehyde sulfurous acid adduct.

Various chelating agents or antifungal agents can be added in the stabilizing bath.

An overflow produced upon washing and/or replenishment of the stabilizing solution can be reused in another step such as a desilvering step.

In the processing using an automatic developing machine, if each processing solution described above is condensed by evaporation, water is preferably added to correct condensation.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and an urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The silver halide light-sensitive material of the present invention can be applied to thermal development light-sensitive materials described in, for example, U.S. Pat. No. 4,500,626, JP-A-60-133449, JP-A-59-218443, JP-A-61-238056, and EP 210,660A2.

The present invention will be described in more detail below by way of its examples, but the present invention is not limited to these examples.

EXAMPLE 1

A plurality of layers having the following compositions were coated on an undercoated triacetylcellulose film support, forming a multilayered color light-sensitive material (hereinafter referred to as "sample 101").

Compositions of light-sensitive layers

Numerals corresponding to each component indicates a coating amount represented in units of g/m$^2$. The coating amount of a silver halide is represented by the converted coating amount of silver. The coating amount of a sensitizing dye is represented in units of moles per mole of a silver halide in the same layer.

SAMPLE 101

| | |
|---|---|
| **Layer 1: Antihalation layer** | |
| Black colloidal silver | silver 0.18 |
| Gelatin | 1.00 |
| **Layer 2: Interlayer** | |
| 2,5-di-t-pentadecylhydroquinone | 0.18 |
| EX-1 | 0.18 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 0.70 |
| **Layer 3: 1st red-sensitive emulsion layer** | |
| Emulsion A | silver 0.10 |
| Emulsion B | silver 0.10 |
| Emulsion F | silver 0.40 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.17 |
| EX-10 | 0.020 |
| EX-14 | 0.17 |

-continued

| | |
|---|---|
| C-1 | 0.015 |
| U-1 | 0.070 |
| U-2 | 0.050 |
| U-3 | 0.070 |
| HBS-1 | 0.060 |
| Gelatin | 0.87 |
| **Layer 4: 2nd red-sensitive emulsion layer** | |
| Emulsion G | silver 0.90 |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| EX-2 | 0.20 |
| Ex-3 | 0.050 |
| EX-10 | 0.015 |
| EX-14 | 0.20 |
| EX-15 | 0.050 |
| C-1 | 0.030 |
| U-1 | 0.070 |
| U-2 | 0.050 |
| U-3 | 0.070 |
| Gelatin | 1.00 |
| **Layer 5: 3rd red-sensitive emulsion layer** | |
| Emulsion D | silver 1.40 |
| Sensitizing dye I | $5.4 \times 10^{-5}$ |
| Sensitizing dye II | $1.4 \times 10^{-5}$ |
| Sensitizing dye III | $2.4 \times 10^{-4}$ |
| EX-2 | 0.097 |
| Ex-3 | 0.010 |
| Ex-4 | 0.080 |
| HBS-1 | 0.07 |
| HBS-2 | 0.05 |
| Gelatin | 1.20 |
| **Layer 6: Interlayer** | |
| Ex-5 | 0.040 |
| HBS-1 | 0.020 |
| Gelatin | 0.80 |
| **Layer 7: 1st green-sensitive emulsion layer** | |
| Emulsion A | silver 0.05 |
| Emulsion B | silver 0.15 |
| Emulsion F | silver 0.10 |
| Sensitizing dye IV | $3.0 \times 10^{-5}$ |
| Sensitizing dye V | $1.0 \times 10^{-4}$ |
| Sensitizing dye VI | $3.8 \times 10^{-4}$ |
| EX-1 | 0.021 |
| Ex-6 | 0.26 |
| Ex-7 | 0.030 |
| Ex-8 | 0.025 |
| C-1 | 0.040 |
| HBS-1 | 0.10 |
| HBS-3 | 0.010 |
| Gelatin | 0.63 |
| **Layer 8: 2nd green-sensitive emulsion layer** | |
| Emulsion C | silver 0.45 |
| Sensitizing dye IV | $2.1 \times 10^{-5}$ |
| Sensitizing dye V | $7.0 \times 10^{-5}$ |
| Sensitizing dye VI | $2.6 \times 10^{-4}$ |
| EX-6 | 0.094 |
| Ex-7 | 0.026 |
| Ex-8 | 0.018 |
| HBS-1 | 0.16 |
| HBS-3 | $8.0 \times 10^{-3}$ |
| Gelatin | 0.50 |
| **Layer 9: 3rd green-sensitive emulsion layer** | |
| Emulsion E | silver 1.20 |
| Sensitizing dye IV | $3.5 \times 10^{-5}$ |
| Sensitizing dye V | $8.0 \times 10^{-5}$ |
| Sensitizing dye VI | $3.0 \times 10^{-4}$ |
| EX-1 | 0.013 |
| Ex-11 | 0.065 |
| Ex-13 | 0.019 |
| HBS-1 | 0.25 |
| HBS-2 | 0.10 |
| Gelatin | 1.54 |
| **Layer 10: Yellow filter layer** | |
| Yellow colloidal silver | silver 0.050 |
| Yellow-5 | 0.080 |
| HBS-1 | 0.030 |
| Gelatin | 0.95 |
| **Layer 11: 1st blue-sensitive emulsion layer** | |
| Emulsion A | silver 0.080 |

-continued

| | |
|---|---|
| Emulsion B | silver 0.070 |
| Emulsion F | silver 0.070 |
| Sensitizing dye VII | $3.5 \times 10^{-4}$ |
| EX-8 | 0.042 |
| Ex-9 | 0.72 |
| HBS-1 | 0.28 |
| Gelatin | 1.10 |
| Layer 12: 2nd blue-sensitive emulsion layer | |
| Emulsion G | silver 0.45 |
| Sensitizing dye VII | $2.1 \times 10^{-4}$ |
| EX-9 | 0.15 |
| Ex-10 | $7.0 \times 10^{-3}$ |
| HBS-1 | 0.050 |
| Gelatin | 0.78 |
| Layer 13: 3rd blue-sensitive emulsion layer | |
| Emulsion H | silver 0.77 |
| Sensitizing dye VII | $2.2 \times 10^{-4}$ |
| EX-9 | 0.20 |
| HBS-1 | 0.070 |
| Gelatin | 0.69 |
| Layer 14: 1st protective layer | |
| Emulsion I | silver 0.20 |
| U-4 | 0.11 |
| U-5 | 0.17 |
| HBS-1 | $5.0 \times 10^{-2}$ |
| Gelatin | 2.50 |
| Layer 15: 2nd protective layer | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 0.70 |

Further, all layers contain W-1, W-2, W-3, B-4, B-5, F-1, F-2, F-3, F-4, F-5, F-6, F-7, F-8, F-9, F-10, F-11, F-12, F-13, iron salt, lead salt, gold salt, platinum salt, iridium salt, and rohdium salt, so that they may have improved storage stability, may be more readily processed, may be more resistant to pressure, more antibacterial and more antifungal, may be better protected against electrical charging, and may be more readily coated.

SAMPLES 102 TO 113

Samples 102 to 113 were prepared by replacing coupler C-1 used in that layers 3, 4 and 5 of sample 101 with other couplers of the present invention and comparative couplers. The kind and amount of the couplers is shown in Table II (The mole ratio of coupler C-1 to 1.0). These amounts had been selected so that samples 101 to 113 may have the same gradient (gamma).

TABLE II

| Sample | Coupler in Layers 3,4,5 Type | Amount | MTF Value 25 cycle/mm Cyan Image | Color Obsurity | Fogging Changes* at 50° C. and 70% | Change in Sensitivity** 14 Days later | Edge Effect |
|---|---|---|---|---|---|---|---|
| 101 (Comparative Example) | C-1 | 1.0 | 0.64 | −0.02 | +0.06 | −0.13 | 1.40 |
| 102 (Comparative Example) | C-2 | 1.2 | 0.65 | −0.03 | +0.06 | −0.11 | 1.41 |
| 103 (Comparative Example) | C-3 | 0.65 | 0.60 | +0.01 | +0.06 | −0.11 | 1.33 |
| 104 (Comparative Example) | C-4 | 0.85 | 0.62 | −0.02 | +0.07 | −0.14 | 1.36 |
| 105 (Comparative Example) | C-5 | 0.40 | 0.64 | −0.02 | +0.05 | −0.12 | 1.39 |
| 106 (Comparative Example) | C-6 | 2.50 | 0.61 | 0.00 | +0.06 | −0.11 | 1.35 |
| 107 (Comparative Example) | C-7 | 0.30 | 0.61 | −0.01 | +0.04 | −0.10 | 1.36 |
| 108 (Invention) | (1) | 0.30 | 0.72 | −0.08 | +0.02 | −0.05 | 1.53 |
| 109 (Invention) | (2) | 0.25 | 0.71 | −0.08 | +0.02 | −0.06 | 1.51 |
| 110 (Invention) | (4) | 0.25 | 0.71 | −0.08 | +0.02 | −0.05 | 1.55 |
| 111 (Invention) | (5) | 1.00 | 0.70 | −0.06 | +0.03 | −0.06 | 1.51 |
| 112 (Invention) | (6) | 0.70 | 0.70 | −0.05 | +0.03 | −0.07 | 1.50 |
| 113 (Invention) | (9) | 0.60 | 0.70 | −0.06 | +0.03 | −0.06 | 1.51 |

*The increase in the fogging of the cyan density
**Relative logarithm of the exposure amount resulting in cyan density of +0.2

These samples were imagewise exposed with white light and subjected to color development in the conditions specified below. The sharpness of each sample was measured by the MTF method known in the art. Also, these samples, thus imagewise exposed, were left to stand at a temperature of 50° C. and a relative humidity of 70% for 14 days, and then developed under the same conditions. Further, samples 101 to 113 were imagewise exposed through a red filter (i.e., filter SC-62 manufactured by Fuji Film), and subjected to uniform exposure of 0.02 CMS and developed. Then, the magenta density at cyan fogging density was subtracted from the magenta density at cyan density of 1.5, and the difference thus obtained was recorded as color turbidity. The results were as is shown in Table 1.

Moreover, soft X rays were irradiated to samples at aperture of 500 μm×0.4 mm, and also at aperture of 15 μm×0.4 mm. Samples were subjected to color development under the same conditions. The average cyan-coloring density ratio in a central portion of each sample was measured and regarded as edge effect. The results were as is also shown in Table 1.

Processing Method

| Step | Processing Time | Process Temp. | Replenish Amount* | Tank volume |
|---|---|---|---|---|
| Color development | 3 min. 15 sec. | 37.8° C. | 25 ml | 10 l |
| Bleaching | 45 sec. | 38° C. | 5 ml | 4 l |
| Bleach-Fixing (1) | 45 sec. | 38° C. | — | 4 l |
| Bleach-Fixing (2) | 45 sec. | 38° C. | 30 ml | 4 l |
| Washing (1) | 20 sec. | 38° C. | — | 2 l |
| Washing (2) | 20 sec. | 38° C. | 30 ml | 2 l |
| Stabilization | 20 sec. | 38° C. | 20 ml | 2 l |
| Drying | 1 min. | 55° C. | | |

*Replenishing amount per meter of a 35-mm wide sample

The bleach-fixing steps and the washing steps were carried out in counter flow from step (2) to step (1). In other words, the step (1) was performed after the step (2). Further, the overflow of the bleaching solution was all used in the bleach-fixing (2). The amount of the bleaching solution transferred in above-mentioned process is 2 ml per meter in the case of the 35-mm wide sample.

| | Tank Solution (g) | Replenishment Solution (g) |
|---|---|---|
| (Color Developing Solution) | | |
| Diethylenetriamine- | 5.0 | 6.0 |

-continued

| | Tank Solution (g) | Replenishment Solution (g) |
|---|---|---|
| pentaacetic acid | | |
| Sodium sulfide | 4.0 | 5.0 |
| Potassium carbonate | 30.0 | 37.0 |
| Potassium bromide | 1.3 | 0.5 |
| Potassium iodide | 1.2 mg | — |
| Hydroxylamine sulfate | 2.0 | 3.6 |
| 4-[N-ethyl-N-β-hydroxylethylamino]-2-methylaniline sulfate | 4.7 | 6.2 |
| Water to make | 1.0 l | 1.0 l |
| pH | 10.00 | 10.15 |
| (Bleaching Solution) | | |
| Ammonium ferric 1,3-diaminopropane tetraacetate monohydrate | 144.0 | 206.0 |
| 1,3-diaminopropane-tetraacetic acid | 2.8 | 4.0 |
| Ammonium bromide | 84.0 | 120.0 |
| Ammonium nitrate | 17.5 | 25.0 |
| Ammonia water (27%) | 10.0 | 1.8 |
| Acetic acid (98%) | 51.1 | 73.0 |
| Water to make | 1.0 l | 1.0 l |
| pH | 4.3 | 3.4 |
| (Bleach-Fixing Solution) | | |
| Ammonium ferric ethylenediamine tetraacetate dihydrate | 50.0 | — |
| Disodium ethylene-diamine tetra-acetate | 5.0 | 25.0 |
| Ammonium sulfite | 12.0 | 20.0 |
| Ammonium thiosulfate aqueous solution (700 g/l) | 290.0 ml | 320.0 ml |
| Ammonia Water (27%) | 6.0 ml | 15.0 ml |
| Water to make | 1.0 l | 1.0 l |
| pH | 6.8 | 8.0 |

WASHING WATER

The same water was used for washing both the mother solution and the replenishment solution. First, passing tap water was passed through a mixed-bed column filled with H-type strong-acidic cation exchange resin (Amberlite IR-120B) and OH-type strong-basic anion exchange resin (Amberlite IRA-400), both resins made by manufactured by Rohm and Haas Company, whereby the calcium and magnesium ion concentration of the water was reduced to 3 mg/l or less. Next, 20 mg/l of sodium isocyanuric dichloride and 150 mg/l of sodium sulfate were added to the water thus processed, thereby obtaining the washing solution. The washing solution had pH value ranging from 6.5 to 7.5.

STABILIZING SOLUTION

The same solution, was used for stabilizing both the tank solution and the replenishment solution.

| | |
|---|---|
| Formalin (37%) | 1.2 ml |
| Surfactant | 0.4 g |
| $C_{10}H_{21}$—O—$(CH_2CH_2O)10^{-H}$ | 1.0 g |
| Ethylene glycol | |
| Water to make | 1.0 l |
| pH | 5.0 to 7.0 |

As is evident from Table II, the samples excelled in color reproducibility and sharpness indicated by MTF value and edge effect, and had their photographic properties little changed under forced-deterioration conditions, i.e., temperature of 50° C. and humidity of 80%. This fact proves that the present invention is effective.

EXAMPLE 2

Sample 201 was prepared in the same method as sample 105 disclosed in JP-A-2-44344, except for two respects. First, the coupler (4) of present invention was added in amounts 0.010 g/m², 0.015 g/m² and 0.027 g/m² to the third layer, the fourth layer and the fifth layer, respectively. Second, the coupler (8) was added to the seventh layer and the ninth layer in amounts of 0.008 g/m² and 0.007 g/m², respectively. Also, samples 202, 203, and 204 were prepared in the same way as sample 201, except that coupler (8) of the seventh and ninth layers was substituted by the couplers (13), (15) and (22), respectively, in the equimolar amount as the coupler (8). Further, sample 205 was prepared in the same way as sample 204, except that the coupler (19) of present invention was added to the eleventh layer in an amount of 0.007 g/m². Still further, samples 206 and 207 were prepared in the same method as sample 205, except that the coupler (19) was substituted by the coupler (4) and the coupler (18), respectively, in the same mole amount as the coupler (19).

X rays were irradiated to these samples in order to determine the edge effect of each sample. The samples were color-developed in the conditions specified below, thereby obtaining cyan images. The edge effect on each cyan image was evaluated. The results were as is shown in Table III.

TABLE III

| Sample | Couplers | Edge Effect |
|---|---|---|
| 105* (Comparative Example) | — | 1.32 |
| 201 (Invention) | (4) (8) | 1.52 |
| 202 (Invention) | (4) (13) | 1.52 |
| 203 (Invention) | (4) (15) | 1.52 |
| 204 (Invention) | (4) (22) | 1.52 |
| 205 (Invention) | (4) (22) (19) | 1.53 |
| 206 (Invention) | (4) (22) | 1.54 |
| 207 (Invention) | (4) (22) (18) | 1.53 |

*Sample 105 disclosed in JP-A-2-44344

The color development was conducted by means of an automatic developing machine in the following conditions, until the cumulative replenishment amount of solution reached three times the capacity of the mother-solution tank used.

| Processing Method | | | | |
|---|---|---|---|---|
| Step | Processing Time | Process Temp. | Replenish Amount* | Tank volume |
| Color development | 3 min. 15 sec. | 38° C. | 45 ml | 10 l |
| Bleaching | 1 min. 00 sec. | 38° C. | 20 ml | 4 l |
| Bleach-Fixing | 3 min. 15 sec | 38° C. | 30 ml | 8 l |
| Washing (1) | 40 sec. | 35° C. | ** | 4 l |
| Washing (2) | 1 min. 00 sec. | 35° C. | 30 ml | 4 l |
| Stabilization | 40 sec. | 38° C. | 20 ml | 4 l |
| Drying | 1 min. 15 sec. | 55° C. | | |

*Replenishing amount per meter of a 35-mm wide sample
**Counter-flow from (2) to (2)

The compositions of the solutions used in the color-developing process are as follows:

| (Color Developing Solution) | Mother | Replenishment |
|---|---|---|

-continued

| | Solution (g) | Solution (g) |
|---|---|---|
| Diethylenetriamine-pentaacetic acid | 1.0 | 1.1 |
| 1-hydroxyethylidene-1,1-disulfonic acid | 3.0 | 3.2 |
| Sodium sulfide | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-(N-ethyl-N-β-hydroxylethylamino)-2-methylaniline sulfate | 4.5 | 5.5 |
| Water to make | 1.0 l | 1.0 l |
| pH | 10.05 | 10.10 |

(Bleaching Solution)

The same solution was used for washing both the mother solution and the replenishment solution.

| | |
|---|---|
| Ammonium ferric ethylenediamine tetra-acetate dihydate | 120.0 g |
| Disodium ethylene-diamine tetraacetate | 10.0 g |
| Ammonium bromide | 100.0 g |
| Ammonium nitrate | 10.0 g |
| Bleaching accelerator $[(CH_3)_2NCH_2CH_2—S]_2.2HCl$ | 0.005 mole |
| Ammonia water (27%) | 15.0 ml |
| Water to make | 1.0 l |
| pH | 6.3 |

(Bleach-Fixing Solution)

The same solution was used for washing both the mother solution and the replenishment solution.

-continued

| | |
|---|---|
| Ammonium ferric ethylenediamine tetraacetic dihydrate | 50.0 g |
| Disodium ethylene-diamine tetraacetate | 5.0 g |
| Sodium sulfite | 12.0 g |
| Ammonium thiosulfate aqueous solution (70%) | 240.0 ml |
| Ammonia Water (27%) | 6.0 ml |
| Water to make | 1.0 l |
| pH | 7.2 |
| (Washing Solution) | |

The same solution was used for washing both the mother solution and the replenishment solution. The solution was one having been prepared as follows. First, passing tap water was passed through a mixed-bed column filled with H-type strong-acidic cation exchange resin (Amberlite IR-120B) and OH-type strong-basic anion exchange resin (Amberlite IRA-400), both resins made by manufactured by Rome and Harse, Inc., whereby the calcium and magnesium ion concentration of the water was reduced to 3 mg/l or less. Next, 20 mg/l of sodium isocyanuric dichloride and 0.15 g/l of sodium sulfate were added to the water thus processed, thereby obtaining the washing solution. The washing solution had pH value ranging from 6.5 to 7.5.

STABILIZING SOLUTION

The same solution, the composition of which is specified below, was used for stabilizing both the mother solution and the replenishment solution.

| | |
|---|---|
| Formalin (37%) | 2.0 ml |
| Polyoxyethylene-p-monononylphenyl ether (mean polymerization degree: 10) | 0.3 g |
| Disodium ethylenediamine tetraacetate | 0.05 g |
| Water to make | 1.0 l |
| pH | 0.5 to 8.0 |

C-1 (Coupler 19 disclosed in JP-A-60-218645)

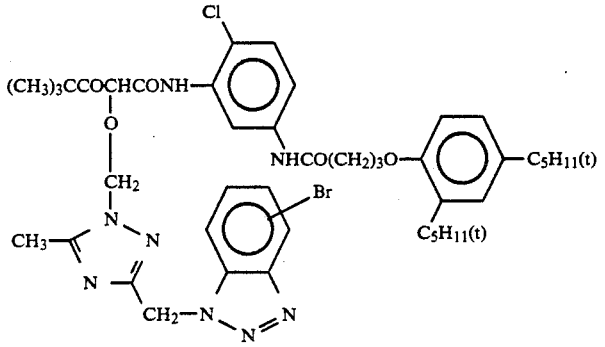

-continued
C-2 (Coupler 1 disclosed in JP-A-60-249148)
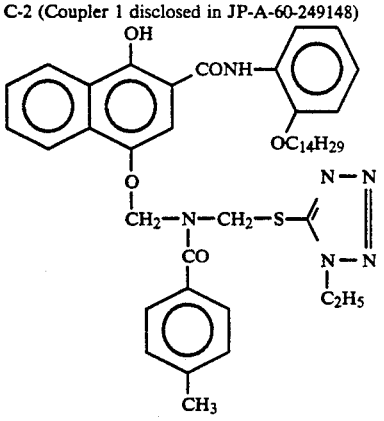
C-3 (Coupler 26 disclosed in JP-A-61-156127)
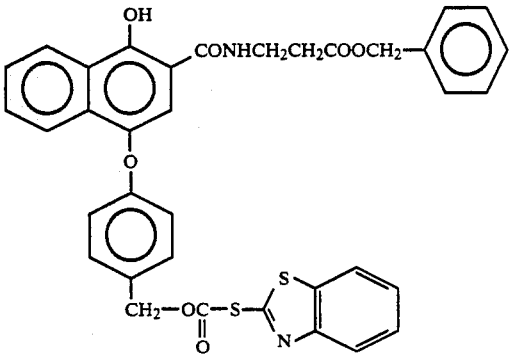
C-4 (Compound 5 disclosed in U.S. Pat. No. 4,861,701)
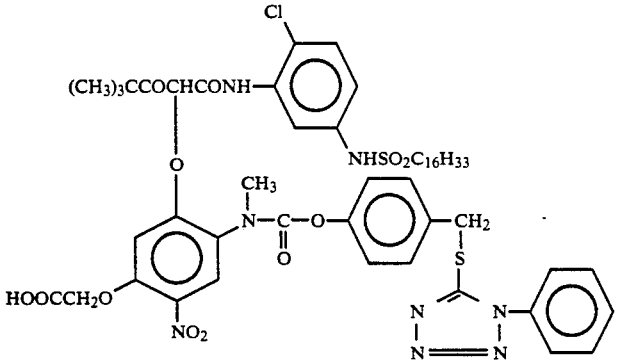
C-5 (Coupler 17 disclosed in Laid-open European Patent Application 354,532)
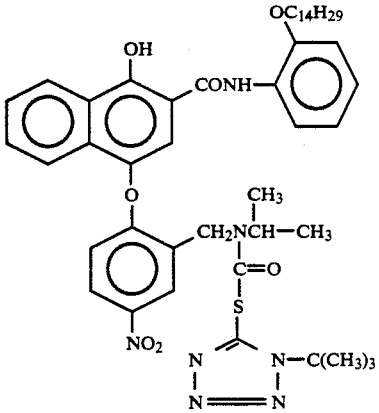

-continued
C-6 (Coupler 24 disclosed in Laid-open Patent Application 89,834)
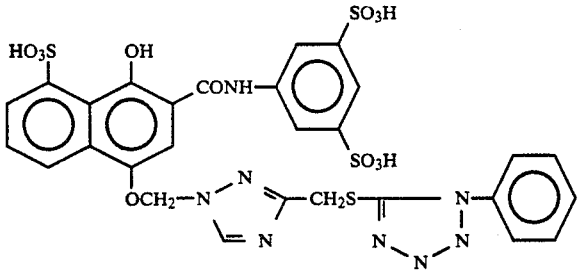
C-7 (coupler 37 disclosed in JP-A-51-146828)
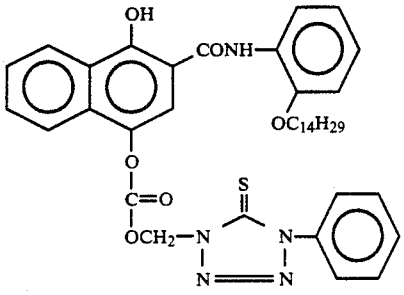
EX-1
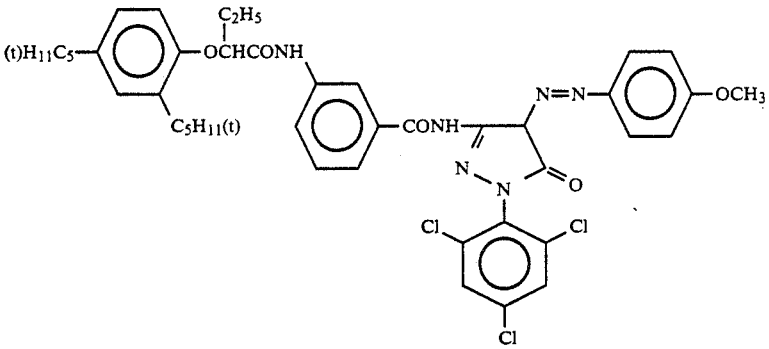
EX-2
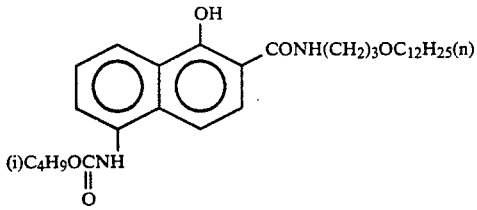
EX-3
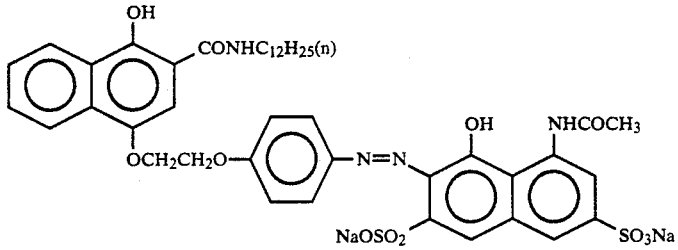

-continued
EX-4
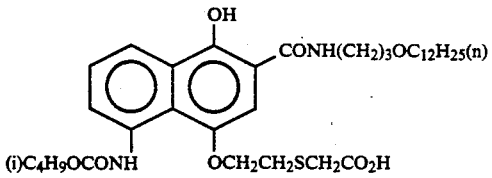
EX-5
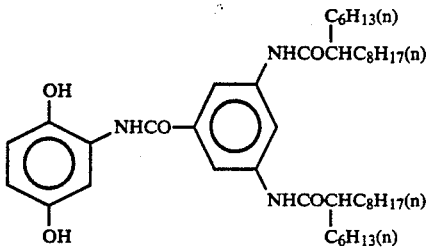
EX-6
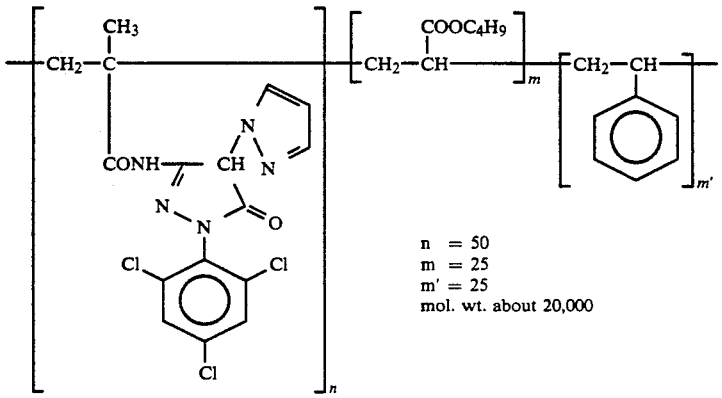
EX-7
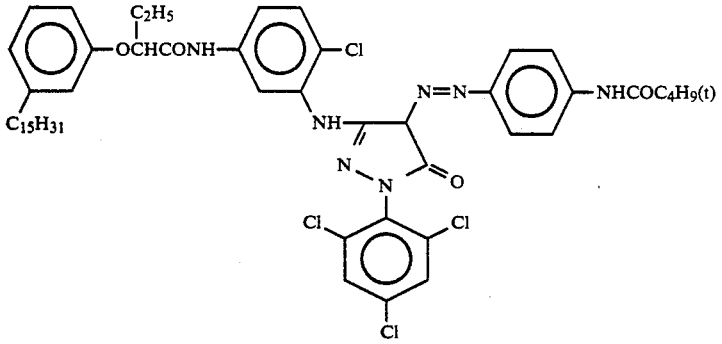
EX-8
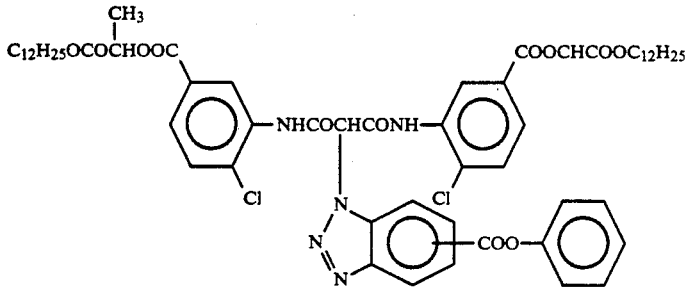

-continued
EX-9
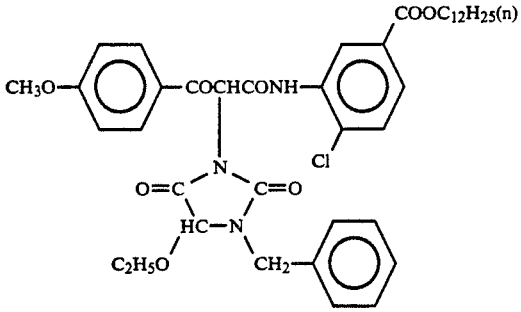
EX-10
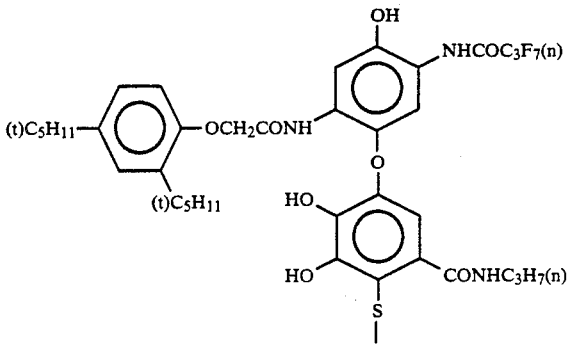
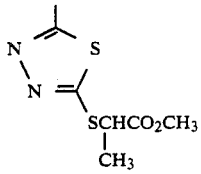
EX-11
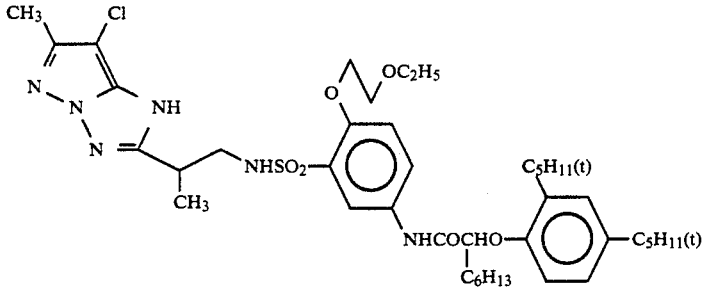
EX-12
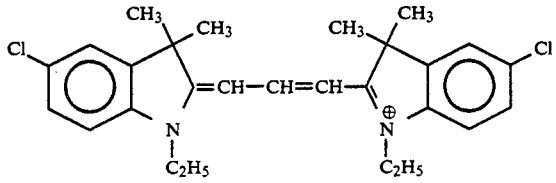
$C_2H_5OSO_3^{\ominus}$ -continued
EX-13
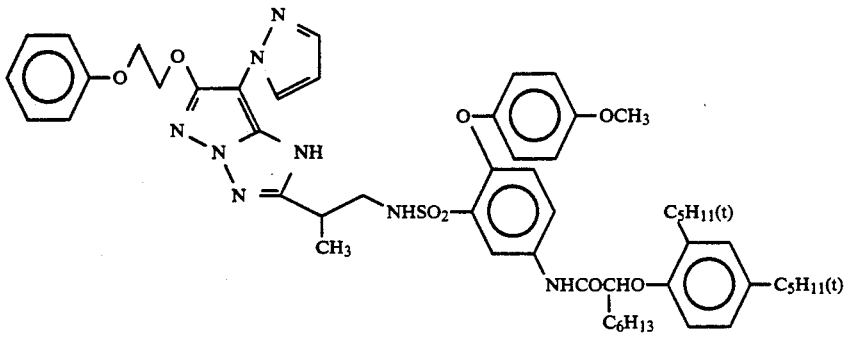
EX-14
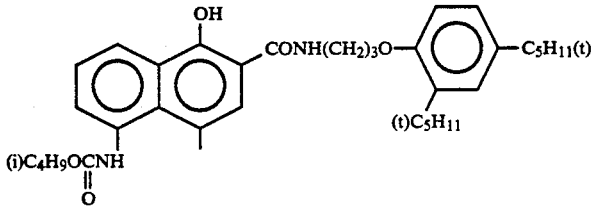
EX-15
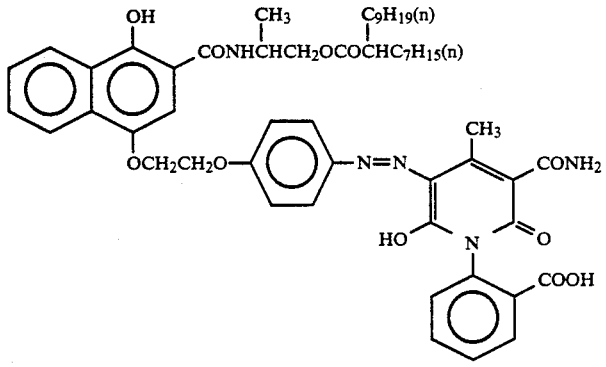
U-1
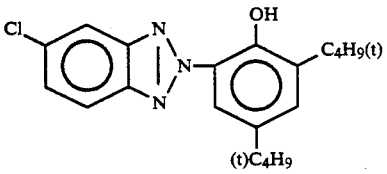
U-2
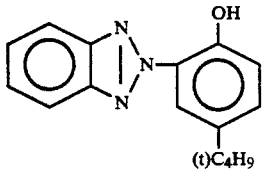
U-3
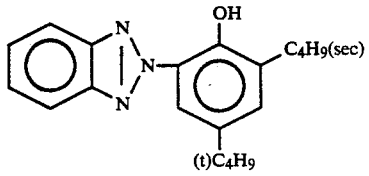

-continued
U-4
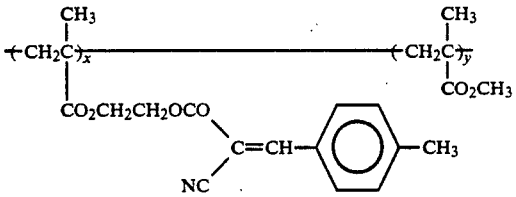
x:y = 70:30 (wt %)
U-5
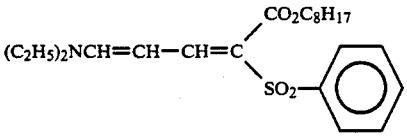
HBS-1 Tricresylphosplate
HBS-2 Di-n-butylphthalate
HBS-3
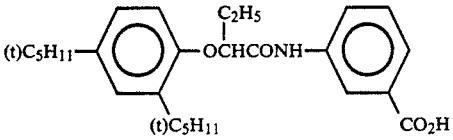
Sensitizing dye I
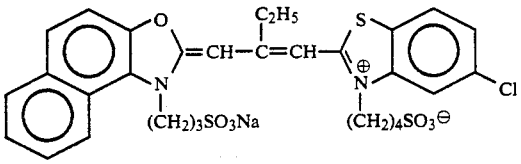
Sensitizing dye II
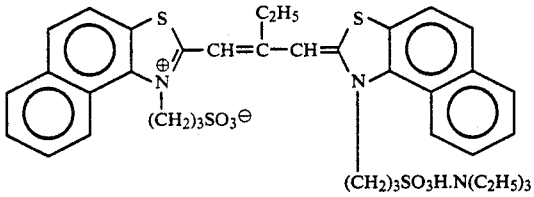
Sensitizing dye III
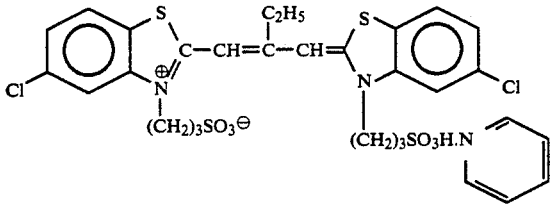
Sensitizing dye IV
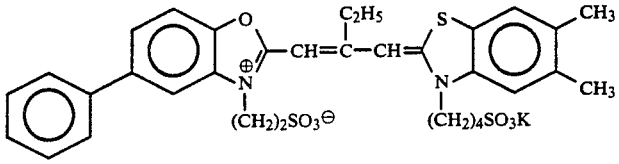

-continued
Sensitizing dye V
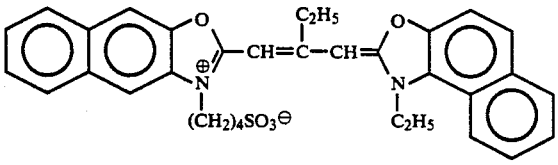
Sensitizing dye IV
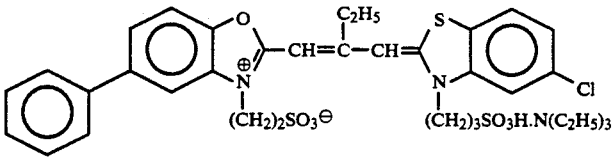
Sensitizing dye I
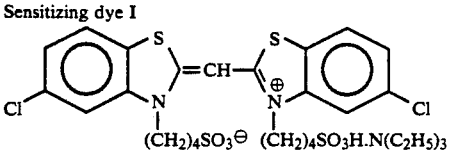
S-1
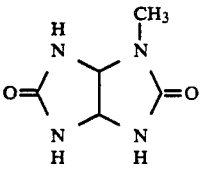
H-1
$CH_2{=}CH{-}SO_2{-}CH_2{-}CONH{-}CH_2$
$CH_2{=}CH{-}SO_2{-}CH_2{-}CONH{-}CH_2$
B-1
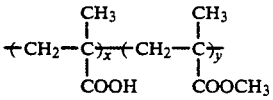
x/y = 10/90
B-2
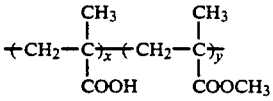
x/y = 40/60
B-3
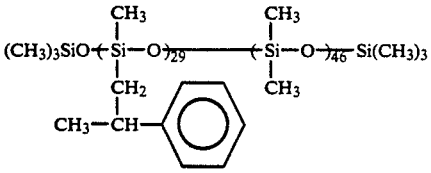
B-4
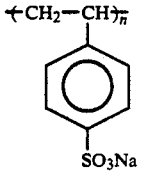

-continued
B-5
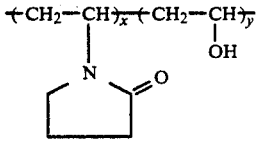
x/y = 70/30
W-1
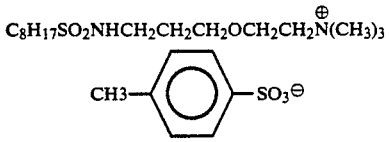
W-2
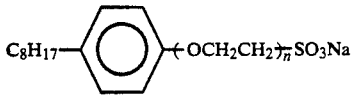
n = 2 to 4
W-3
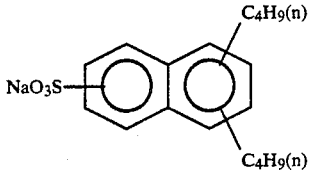
F-1
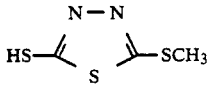
F-2
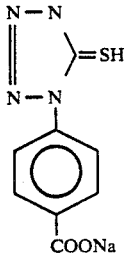
F-3
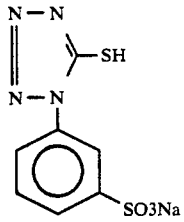
F-4
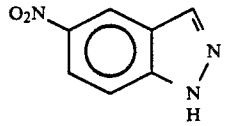
F-5
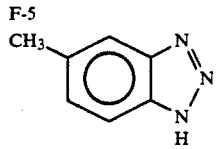

-continued

F-6

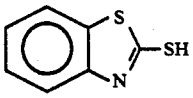

F-7

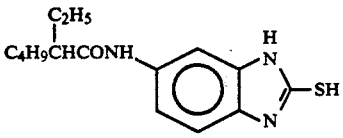

F-8

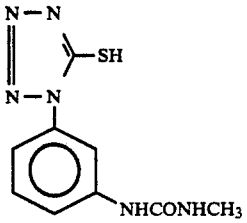

F-9

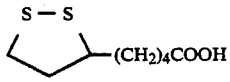

F-10

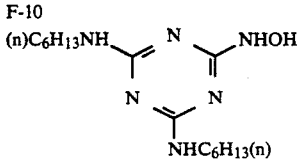

F-11

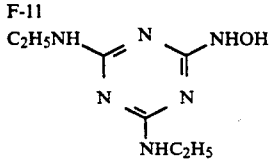

F-12

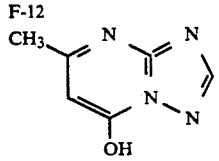

F-13

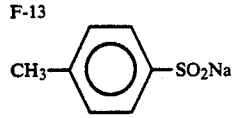

TABLE IV

| | AgI Content (%) | Grain Size (μm) | Variation Coefficient of Grain Size (%) | Diameter/ Thickness | Ratio in Silver Amount [AgI content (%)] |
|---|---|---|---|---|---|
| Emulsion A | 4.0 | 0.45 | 18 | 3.5 | Core/Shell = 1/3(13/1), Double-structure grain |
| Emulsion B | 8.9 | 0.70 | 14 | 5.5 | Core/Shell = 3/7(25/2), Double-structure grain |
| Emulsion C | 10 | 0.75 | 15 | 5.0 | Core/Shell = 1/2(24/3), Double-structure grain |
| Emulsion D | 16 | 1.05 | 17 | 7.5 | Core/Shell = 4/6(40/0), Double-structure grain |
| Emulsion E | 10 | 1.05 | 19 | 2.5 | Core/Shell = 1/2(24/3), Double-structure grain |
| Emulsion F | 4.0 | 0.25 | 18 | 1.0 | Core/Shell = 1/3(13/1), Double-structure grain |
| Emulsion G | 14.0 | 0.75 | 15 | 3.5 | Core/Shell = 1/2(42/0), Double-structure grain |
| Emulsion H | 14.5 | 1.30 | 16 | 7.5 | Core/Shell = 37/63(13/1), Double-structure grain |

TABLE IV-continued

| | AgI Content (%) | Grain Size (μm) | Variation Coefficient of Grain Size (%) | Diameter/ Thickness | Ratio in Silver Amount [AgI content (%)] |
|---|---|---|---|---|---|
| Emulsion I | 1 | 0.07 | 15 | 1 | Homogeneous gain |

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A silver halide color photographic light-sensitive material comprising at least one light-sensitive silver halide emulsion layer formed on a support wherein said light-sensitive material contains a compound represented by the following general formula (I):

General formula (I)

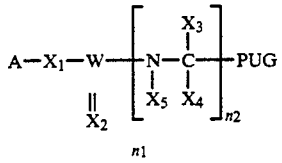

wherein A is (i) a coupler residue bonded to $X_1$ at a coupling position at A or (ii) an oxidation-reduction group which is cleavable from $X_1$ by oxidation or reduction, $X_1$ is an oxygen atom, $X_2$ is an oxygen atom, W is a carbon atom or a sulfur atom, $X_3$ and $X_4$ are each a hydrogen atom or an organic group, $X_5$ is an alkyl group, PUG is a photographically useful group which bonds to the remainder of the compound represented by general formula (I) through a hetero-atom in PUG, $n_1$ is 1, $n_2$ is either 1 or 2, two $X_3$, two $X_4$, and two $X_5$ are either identical or different, when $n_2$ is 2; and wherein any two of $X_3$, $X_4$, $X_5$ do not form a ring by bonding.

2. The material according to claim 1, wherein PUG represents a development restrainer.

3. The material according to claim 1, wherein $X_1$—W(=$X_2$)$n_1$— is a member selected from the group consisting of —OC(=O)—, and —OS(=O).

4. The material according to claim 1, wherein $X_1$—W(=$X_2$)$n_1$— is —OC(=O)—.

5. The material according to claim 1, wherein at least one of $X_3$ and $X_4$ is a hydrogen atom.

6. The material according to claim 1, wherein both $X_3$ and $X_4$ are a hydrogen atom.

7. The material according to claim 1, wherein a formula weight of

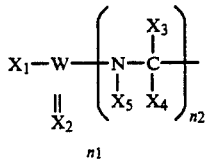

is 200 or less.

8. The material according to claim 1, wherein $n_2$is 1.

9. The material according to claim 1, wherein PUG represents a member selected from the group consisting of a development restrainer, a dye, a fogging agent, a developing agent, a coupler, a bleaching accelerator, and a fixing accelerator.

* * * * *